US005283166A

United States Patent [19]

Kobayashi et al.

[11] Patent Number: 5,283,166

[45] Date of Patent: Feb. 1, 1994

[54] YELLOW DYE-FORMING COUPLER AND SILVER HALIDE COLOR PHOTOGRAPHIC LIGHT-SENSITIVE MATERIAL CONTAINING THE SAME

[75] Inventors: Hidetoshi Kobayashi; Yasuhiro Yoshioka; Yoshio Shimura, all of Minami-Ashigara, Japan

[73] Assignee: Fuji Photo Film Co., Ltd., Kanagawa, Japan

[21] Appl. No.: 883,130

[22] Filed: May 14, 1992

[30] Foreign Application Priority Data

May 21, 1991 [JP] Japan ..... 3-144063

[51] Int. Cl.[5] ..... G03C 7/36

[52] U.S. Cl. ..... 430/556; 430/557

[58] Field of Search ..... 430/556, 557

[56] References Cited

U.S. PATENT DOCUMENTS

Re. 27,848 12/1973 Weissberger et al. ..... 430/557
4,336,327 6/1982 Tanaka et al. ..... 430/557
4,992,360 2/1991 Tsuruta et al. ..... 430/557

FOREIGN PATENT DOCUMENTS 47-26133 10/1972 Japan .
56-87041 7/1981 Japan .

*Primary Examiner*—Lee C. Wright
*Attorney, Agent, or Firm*—Birch, Stewart, Kolasch & Birch

[57] ABSTRACT

An acylacetamide-type yellow dye-forming coupler. The acyl group of the coupler is a bicyclo[1.1.1]pentane-1-carbonyl group, a bicyclo[2.1.1]hexane-1-carbonyl group, a bicyclo[2.2.1.]heptane-1-carbonyl group, a bicyclo[2.2.2]octane-1-carbonyl group, a tricyclo[3.1.1.$0^{3,6}$]heptane-6-carbonyl group, a tricyclo[3.3.0.$0^{3,7}$]octane-1-carbonyl group, or a tricyclo[3.3.1.$0^{3,7}$]nonane-3-carbonyl group.

20 Claims, No Drawings

YELLOW DYE-FORMING COUPLER AND SILVER HALIDE COLOR PHOTOGRAPHIC LIGHT-SENSITIVE MATERIAL CONTAINING THE SAME

BACKGROUND OF THE INVENTION

1. Field of the Invention

The present invention relates to a novel acylacetamide-type yellow dye-forming coupler and a silver halide color photographic light-sensitive material containing the same.

2. Description of the Related Art

A silver halide color photographic light-sensitive material forms a dye image therein by exposure, followed by color development in which an oxidized aromatic primary amine developing agent reacts with a dye-forming coupler (to be referred to as a coupler hereinafter) to form the dye image.

In this method, a color reproduction method using subtractive color processes is generally used. To reproduce blue, green and red images, dye images of yellow, magenta, and cyan which have a relationship of complementary colors with blue, green, and red are formed. An acylacetamide coupler and a malondianilide coupler are used as yellow dye-forming couplers (to be referred to as yellow couplers hereinafter) to form a yellow dye image. A 5-pyrazolone coupler and a pyrazolotriazole coupler, for example, are generally used as magenta couplers to form a magenta dye image. A phenol coupler and a naphthol coupler are generally used as cyan couplers to form a cyan dye image.

Yellow, magenta, cyan dyes obtained from these couplers are generally used in silver halide emulsion layers and their adjacent layers which have sensitivities to radiations having a relationship of complementary colors with radiations absorbed by these dyes.

As the yellow coupler and especially image formation couplers, an acylacetamide coupler represented by a benzoylacetanilide coupler or a pivaloylacetanilide coupler is generally used. The former coupler has a high coupling activity with an oxidized form of an aromatic primary amine developing agent and can produce a yellow dye having a large molecular extinction coefficient. Thus, this coupler is mainly used for a high-speed photographic color light-sensitive material and, particularly, a color negative film. The latter coupler is excellent in spectral absorption characteristics and fastness of its yellow dye, and is mainly used for color paper and a color reversal film.

The benzoylacetanilide-type coupler is excellent in coupling reactivity with an oxidized form of an aromatic primary amine developing agent during color development, and the resultant yellow azomethine dye has a large molecular extinction coefficient. However, the benzoylacetanilide-type coupler is poor in spectral absorption characteristics of a yellow image. The pivaloylacetanilide-type coupler is excellent in spectral absorption characteristics and stability of the yellow image. However, this coupler is poor in coupling reactivity with the oxidized form of the aromatic primary amine developing agent during color development. In addition, the resultant yellow azomethine dye has a small molecular extinction coefficient.

The excellent coupling reactivity of the coupler and the large molecular extinction coefficient of the resultant dye allow a high sensitivity, the large gamma value, and a high color forming density, i.e., excellent color forming properties. The excellent spectral absorption characteristics in the yellow image indicate, for example, that the longer-wavelength portion of the spectral absorption decreases sharply to zero, exhibiting less unnecessary absorption in the green region.

Strong demand, therefore, has arisen for developing a yellow coupler having both advantages, i.e., excellent color forming properties (i.e., excellent coupling reactivity of the coupler and the large molecular extinction coefficient); and excellent spectral absorption characteristics and fastness of the color image.

Examples of the acyl group of the acylacetanilidetype coupler are pivaloyl group, 7,7-dimethylnorbornane-1-carbonyl group and 1-methylcyclohexane-1-carbonyl group disclosed in U.S. Patent Re 27,848; cyclopropane-1-carbonyl group and cyclohexane-1-carbonyl group disclosed in JP-A-47-26133 ("JP-A" means Published Unexamined Japanese Patent Application); and adamantane-1-carbonyl group disclosed in JP-A-56-87041. The couplers having these acyl groups are poor in coupling reactivity or have small molecular extinction coefficients, or are poor in spectral absorption characteristics or stability of dye images.

Stronger demand has arisen for a higher sensitivity, better image quality, and better toughness in recent photographic light-sensitive materials. Accordingly, demand has arisen for developing a coupler excellent in color forming properties, and spectral absorption characteristics and fastness of dye images. However, it is difficult for the conventional yellow couplers including those described in the above three patent publications to simultaneously satisfy all these requirements.

SUMMARY OF THE INVENTION

It is, therefore, a first object of the present invention to provide a yellow coupler excellent in color forming properties and a silver halide color photographic light-sensitive material containing this yellow coupler.

It is a second object of the present invention to provide a yellow coupler excellent in spectral absorption characteristics of the yellow dye image formed upon color development, and a silver halide color photographic light-sensitive material containing this yellow coupler.

It is a third object of the present invention to provide a yellow coupler excellent in stability or fastness of a yellow dye image formed by color development against heat, light, and moisture, and a silver halide color photographic light-sensitive material.

The above objects have been attained according to the present invention by a yellow coupler (1) and a silver halide color photographic light-sensitive material (2) as follows:

(1) An acylacetamide-type yellow dye-forming coupler in which the acyl group is selected from the group consisting of a bicyclo[1.1.1]pentane-1-carbonyl group, a bicyclo[2.1.1]hexane-1-carbonyl group, a bicyclo[2.2.1]heptane-1-carbonyl group, a bicyclo[2.2.2]octane-1-carbonyl group, a tricyclo[3.1.1.0$^{3,6}$]heptane-6-carbonyl group, a tricyclo[3.3.0.0$^{3,7}$]octane-1-carbonyl group, and a tricyclo[3.3.1.0$^{3,7}$]nonane-3-carbonyl group, all of which can be substituted, provided that if the acyl group is a bicyclo[2.2.1]heptane-1-carbonyl group, one in which the 7-position is substituted is excluded. The thus defined coupler is referred to as a yellow coupler of the present invention.

The coupler of the present invention can be represented by a formula: A—$Y_R$ where A is the acyl group as defined above, and $Y_R$ is a residue produced by removing the acyl group A from the coupler of the present invention.

(2) A silver halide color photographic light-sensitive material containing at least one yellow dye-forming coupler described in (1).

DETAILED DESCRIPTION OF THE PREFERRED EMBODIMENTS

The yellow coupler of the present invention will be described in detail.

The yellow coupler of the present invention is preferably represented by formula (1) below:

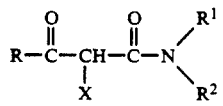

formula (1)

In formula (1), R represents a bicyclo[1.1.1]pentane-1-yl, a bicyclo[2.1.1]hexane-1-yl, a bicyclopentane[2.2.1]heptane-1-yl, a bicyclo[2.2.2]octane-1-yl, a tricyclo[3.1.1.$0^{3,6}$]heptane-6-yl, a tricyclo[3.3.0.$0^{3,7}$]nonane-1-yl, or a tricyclo[3.3.1.$0^{3,7}$]nonane-3-yl group, all of which may be substituted, provided that if R is a bicyclo[2.2.1]heptane-1-yl group, one in which the 7-position is substituted is excluded.

In formula (1), each of $R^1$ and $R^2$ independently represents hydrogen atom, an alkyl group, a cycloalkyl group, an alkenyl group, an alkinyl group, an aralkyl group, an aryl group, or a heterocyclic group.

In formula (1), X represents hydrogen atom or a group (to be referred to as a split-off group hereinafter) which can split off upon a coupling reaction with an oxidized form of an aromatic primary amine developing agent.

The yellow coupler of the present invention is preferably represented by formula (2) below:

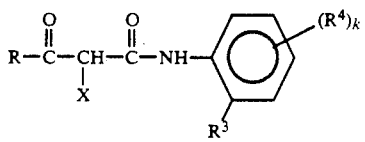

formula (2)

In formula (2), R and X are the same as those of formula (1).

In formula (2), $R^3$ represents hydrogen atom, a halogen atom (F, Cl, Br, or I; this applies in the following description of formula (2)), an alkoxy group, an aryloxy group, an alkyl group, or an amino group (including mono-and di-substituted amino groups), $R^4$ represents a group substitutable on a benzene ring, and k represents an integer of 0 to 4.

Examples of $R^4$ are a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an ureido group, a sulfamoylamino group, an alkoxycarbonylamino group, an alkoxysulfonyl group, an acyloxy group, nitro group, a heterocyclic group, cyano group, an acyl group, an amino group, an imido group, an alkylsulfonyloxy group, an arylsulfonyloxy group, a carboxyl group, a sulfo group, and a hydroxyl group (these substitutent groups are collectivety referred to as substituent group A). Examples of the split-off group X are a heterocyclic group which bonds to the coupling position through a nitrogen atom, an aryloxy group, an arylthio group, an acyloxy group, an alkylsulfonyloxy group, an arylsulfonyloxy group, a heterocyclic oxy group, and a halogen atom.

When a substituent in formula (1), et seq., is an alkyl group or contains an alkyl group, the alkyl group means, unless otherwise defined, a straight-chain, branched, or cyclic alkyl group which may be substituted and may contain an unsaturated bond.

In formula (1), et seq., if the substituent is an aryl group or contains an aryl group, this aryl group means a single-ring or fused-ring aryl group, unless otherwise defined.

In formula (1), et seq., if the substituent is a heterocyclic group or contains a heterocyclic group, this heterocyclic group means a 3- to 8-membered single-ring or fused-ring heterocyclic group which contains at least one hetero atom selected from O, N, S, P, Se, and Te in its ring and may be substituted, unless otherwise defined.

The substituents preferably used in formula (2) will be described below.

R—CO— in formula (2) is preferably represented by formulas (3), (4), (5), (6), (7), (8), or (9) as follows:

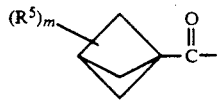

formula (3)

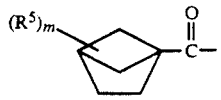

formula (4)

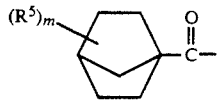

formula (5)

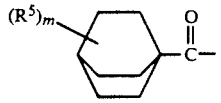

formula (6)

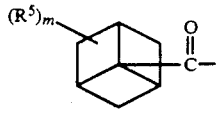

formula (7)

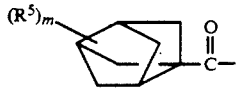

formula (8)

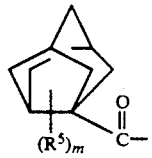

formula (9)

In formulas (3) to (9), $R^5$ represents a group substitutable to bicycloalkane or tricycloalkane, and m represents an integer of 0 to 7. If m represents 2 or more, the plural groups $R^5$ may be the same or different, provided that $R^5$ is not substituted at the 7-position of the group represented by formula (5).

$R^5$ preferably represents a group selected from a halogen atom, cyano group, an alkyl group, an aryl group, an alkoxy group, an aryloxy group, an alkylthio group, an arylthio group, an alkylsulfonyl group, an arylsulfonyl group, an acyl group, an alkoxycarbonyl group, an aryloxycarbonyl group, a carbonamide group, a sulfonamide group, an imide group, a heterocyclic group, a carbamoyl group, a sulfamoyl group, an alkoxycarbonylamino group, a sulfamoylamino group, a phosphono group, an ureido group, carboxyl group, a sulfo group, and hydroxyl group, and more preferably represents a halogen atom, cyano group, an alkyl group, an aryl group, or an acyl group.

If $R^5$ represents an acyl group, a group represented by formula (10) below is preferable.

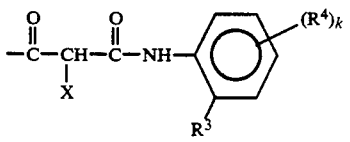

formula (10)

$R^3$, $R^4$, X, and k in formula (10) are the same as those in formula (2).

The substitution position of $R^5$ in each of the groups represented by formulas (3) to (9) is preferably a position except for α-position of the carbonyl group, and more preferably a bridge-head position.

Preferably, m represents an integer of 0 to 4. More preferably, m represents an integer of 0 or 1.

A total number of carbon atoms (to be referred to as a C number hereinafter) of the group represented by formula (3) is preferably 6 to 36, and more preferably 6 to 16.

The C number of the group represented by formula (4) is preferably 7 to 36, and more preferably 7 to 24.

The C number of the group represented by formula (5) is preferably 8 to 36, and more preferably 8 to 24.

The C number of the group represented by formula (6) is preferably 9 to 36, and more preferably 9 to 24.

The C number of the group represented by formula (7) is preferably 8 to 36, and more preferably 8 to 24.

The C number of the group represented by formula (8) is preferably 9 to 36, and more preferably 9 to 24.

The C number of the group represented by formula (9) is preferably 10 to 36, and more preferably 10 to 24.

In formula (2), $R^3$ preferably represents a halogen atom, or an alkoxy group having a C number of 1 to 30, an aryloxy group having a C number of 6 to 30, an alkyl group having a C number of 1 to 30, or an amino group having a C number of 0 to 30, which group may be substituted. Examples of its substituent include a halogen atom, an alkyl group, an alkoxy group, and an aryloxy group.

In formula (2), $R^4$ preferably represents a halogen atom, an alkyl group having a C number of 1 to 30, an aryl group having a C number of 6 to 30, an alkoxy group having a C number of 1 to 30, an alkoxycarbonyl group having a C number of 2 to 30, an aryloxycarbonyl group having a C number of 7 to 30, a carbonamido group having a C number of 1 to 30, a sulfonamido group having a C number of 1 to 30, a carbamoyl group having a C number of 1 to 30, a sulfamoyl group having a C number of 0 to 30, an alkylsulfonyl group having a C number of 1 to 30, an arylsulfonyl group having a C number of 6 to 30, an ureido group having a C number of 1 to 30, a sulfamoylamino group having a C number of 0 to 30, an alkoxycarbonylamino group having a C number of 2 to 30, a heterocyclic group having a C number of 1 to 30, an acyl group having a C number of 1 to 30, an alkylsulfonyloxy group having a C number of 1 to 30, or an arylsulfonyloxy group having a C number of 6 to 30, which group may be substituted. Examples of its substituent include those selected from the substituent group A.

In formula (2), k preferably represents an integer of 1 or 2, and the substitution position of $R^4$ is preferably a meta or para position to the following group:

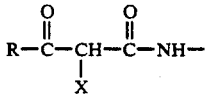

In formula (2), X represents a heterocyclic or aryloxy group which bonds to the coupling position through a nitrogen atom.

If X represents a heterocyclic group, X preferably represents a 5- to 7-membered single-ring or fused-ring heterocyclic group which may be substituted. Examples of this heterocyclic group are succinimide, maleinimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazolidine-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, and 2-imino-1,3,4-thiazolidine-4-one. These heterocyclic rings may be substituted. Examples of substituents of these heterocyclic rings include those selected from the substituent group A.

When X represents an aryloxy group, X is preferably an aryloxy group having a C number of 6 to 30 and may be substituted with a group selected from the substituents enumerated above as substituents when X represents a heterocyclic ring. Preferable substitutes of the aryloxy group are a halogen atom, cyano, nitro, carboxyl, trifluoromethyl, an alkoxycarbonyl group, a carbonamide group, a sulfonamide group, a carbamoyl group, a sulfamoyl group, an alkylsulfonyl group, an arylsulfonyl group, and cyano.

Particularly, preferred substituents in formula (2) will be described below.

Of the yellow couplers of formula (2), those containing R—CO— represented by formula (3), (4), or (7) are particularly excellent in color forming properties and spectral absorption characteristics of the dye image, and are preferred. Of these yellow couplers, the yellow coupler containing R—CO— represented by formula (3) is preferable.

Of the yellow couplers of formula (2), those containing R—CO— represented by formula (5), (6), (8) or (9) are particularly excellent in fastness of the dye image, and are preferred. Of these yellow couplers, the yellow coupler containing R—CO— represented by formula (8) or (9) is preferable.

$R^3$ particularly preferably represents chlorine atom, fluorine atom, an alkyl group (for example, methyl, trifluoromethyl, ethyl, isopropyl, and t-butyl) having a C number of 1 to 6, an alkoxy group (for example, methoxy, ethoxy, methoxyethoxy, and butoxy) having a C number of 1 to 24, or an aryloxy group (for example, phenoxy, p-tolyloxy, and p-methoxyphenoxy) having a C number of 6 to 24, and most preferably chlorine atom, methoxy, or trifluoromethyl.

$R^4$ particularly preferably represents a halogen atom, an alkoxy group, an alkoxycarbonyl group, an aryloxycarbonyl group, a carbonamido group, a sulfonamido group, a carbamoyl group, or a sulfamoyl group, and most preferably an alkoxy group, an alkoxycarbonyl group, a carbonamido group, a sulfamoyl group, or a sulfonamido group.

X is particularly preferably a group represented by formula (11) or (12) below:

formula (11)

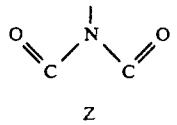

Z formula (12)

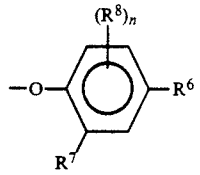

In formula (11), Z represents —O—$CR^9R^{10}$—, —S—CR—$^9R^{10}$, —$NR^{11}$—$CR^9R^{10}$—, —$NR^{11}$—$NR^{12}$—, —$NR^{11}$—CO—, —$CR^9R^{10}$—$CR^{13}R^{14}$—, or —$CR^{15}$=$CR^{16}$— wherein each of $R^9$, $R^{10}$, $R^{13}$, and $R^{14}$ represents hydrogen atom, an alkyl group, an aryl group, an alkoxy group, an aryloxy group, an alkylthio group, an arylthio group, an alkylsulfonyl group, an arylsulfonyl group, or an amino group, each of $R^{11}$ and $R^{12}$ represents hydrogen atom, an alkyl group, an aryl group, an alkylsulfonyl group, an arylsulfonyl group, or an alkoxycarbonyl group, and each of $R^{15}$ and $R^{16}$ represents a hydrogen atom, an alkyl group, or an aryl group. $R^{15}$ and $R^{16}$ may be taken together to form a benzene ring. $R^9$ and $R^{10}$, $R^{10}$ and $R^{11}$, $R^{11}$ and $R^{12}$, or $R^9$ and $R^{13}$ may combine with each other to form a ring (for example, cyclobutane, cyclohexane, cycloheptane, cyclohexene, pyrrolidine, or piperidine).

Of the heterocyclic groups represented by formula (11), those in which Z represents —O—$CR^9R^{10}$, —$NR^{11}$—$CR^9R^{10}$—, or —$NR^{11}$—$NR^{12}$— are particularly preferred.

The heterocyclic group represented by formula (11) has a C number of 2 to 30, preferably 4 to 20, and more preferably 5 to 16.

In formula (12), at least one of $R^6$ and $R^7$ is a member selected from a halogen atom, cyano, nitro, trifluoromethyl, carboxyl, an alkoxycarbonyl group, a carbonamido group, a sulfonamido group, a carbamoyl group, a sulfamoyl group, an alkylsulfonyl group, an arylsulfonyl group, and an acyl group, and the other may also be a hydrogen atom, an alkyl group, or an alkoxy group. $R^8$ represents the same group as $R^6$ or $R^7$, and m represents an integer of 0 to 2. The aryloxy group represented by formula (12) has a C number of 6 to 30, preferably 6 to 24, and more preferably 6 to 15.

A coupler represented by formula (1) may form dimers or higher polymers, which combine together via a polyvalent group having two or more valencies in the substituent R, $R^1$, $R^2$, or X. In this case, the number of carbon atoms may fall outside the range of carbon atoms represented in each substituent described above.

If a coupler represented by formula (1) forms a polymer, a homopolymer or copolymer of an addition-polymerizable ethylenically unsaturated compound (yellow color forming monomer) having a yellow dye-forming coupler moiety is a typical example and is preferably represented by formula (13) below:

$$-(G_i)_{gi}-(H_j)_{hj}- \quad (13)$$

In formula (13), $G_i$ is a repeating unit derived from the color forming monomer and is a group represented by formula (14) below. $H_j$ is a repeating unit derived from a non-color forming monomer. i represents a positive integer, and j represents 0 or a positive integer. gi and hj represent wt % of $G_i$ and $H_j$, respectively. If i or j represents 2 or more, $G_i$ or $H_j$ represents a plurality of types of repeating units.

Formula (14)

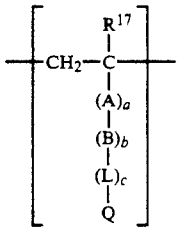

In formula (14), $R^{17}$ represents hydrogen atom, an alkyl group having 1 to 4 carbon atoms, or a chlorine atom, A represents —CONH—, —COO—, or a substituted or unsubstituted phenylene group, B represents a substituted or unsubstituted, alkylene group, phenylene group, or aralkylene group, and L represents —CONH—, —NHCONH—, —NHCOO—, —NHCO—, —OCONH—, —NH—, —COO—, —OCO—, —CO—, —O—, —S—, —$SO_2$—, $NHSO_2$—, or —$SO_2NH$—. Each of a, b, and c represents an integer of 0 or 1. Q represents a yellow coupler moiety obtained by eliminating one hydrogen atom from R, $R^1$, $R^2$, or X or the compund represented by formula (1).

Examples of the non-color forming ethylenic monomer which gives the repeating unit $H_j$ and which is not coupled with an oxidized form of an aromatic primary amine developing agent are acrylic acid, α-chloroacrylic acid, α-alkylacrylic acid (for example, methacrylic acid), amides or esters derived from these acrylic acids (for example, acrylamide, methacrylamide, n-butylacrylamide, t-butylacrylamide, diacetoneacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxyethyl methacrylate), vinyl esters (for example, vinyl acetate, vinyl propionate, and vinyl laurate), acrylonitrile, methacrylonitrile, aromatic vinyl compounds (for example, styrene and its derivatives, for example, vinyl toluene, divinyl benzene, vinyl acetophenone, and sulfostyrene), itaconic acid, citoraconic acid, crotonic acid, vinylidene chloride, a vinyl alkyl ester (e.g., vinyl ethyl ether), maleate esters, N-vinyl-2-pyrrolidone, N-vinyl pyridine, and 2- and -4-vinyl pyridine.

Particularly, the acrylates, methacrylates, and maleates are preferable. Two or more non-color forming ethylenic monomers can be used together. Examples of these monomers are methyl acrylate and butyl acrylate; butyl acrylate and styrene; butyl methacrylate and methacrylic acid; and methyl acrylate and diacetoneacrylamide.

As is known well in the field of polymer couplers, the ethylenically unsaturated monomer to be copolymerized with the vinyl-based monomer corresponding to formula (14) is selected to obtain good influences on the form of a copolymer to be formed, e.g., on a solid, liquid, or micellar state, physical properties, and/or chemical properties such as solubility (solubility in water or an organic solvent), compatibility with a binder (for example, gelatin) of a photographic colloidal composition, flexibility of the copolymer, its thermal stability, a coupling reactivity with an oxidized form of a developing agent, resistance to diffusion in the photographic colloid. These copolymers may be a random copolymer or a copolymer having a specific sequence (for example, a block copolymer or an alternating copolymer).

The number-average molecular weight of the yellow polymer coupler used in the present invention is generally on the order of several thousands to several hundred thousands. However, an oligomer-like polymer coupler having a number-average molecular weight of 5,000 or less can also be used.

The yellow coupler used in the present invention may be a lipophilic polymer soluble in an organic solvent (for example, ethyl acetate, butyl acetate, ethanol, methylene chloride, cyclohexanone, dibutyl phthalate, or tricresyl phosphate), a hydrophilic polymer miscible with a hydrophilic colloid such as an aqueous gelatin solution, or a polymer having a structure and nature capable of forming micells in a hydrophilic colloid.

The yellow polymer coupler used in the present invention may be prepared by emulsifying and dispersing a lipophilic polymer coupler in an aqueous gelatin solution in the form of a latex after the lipophilic polymer coupler is obtained by polymerizing the vinyl-based monomer for giving a coupler unit represented by formula (14) and is dissolved in an organic solvent. Alternatively, the yellow polymer coupler may be directly formed by emulsion polymerization.

A method described in U.S. Pat. No. 3,451,820 can be used as a method of emulsifying and dispersing a lipophilic polymer coupler in an aqueous gelatin solution in the form of a latex, and methods described in U.S. Pat. Nos. 4,080,211 and 3,370,952 can be used in emulsion polymerization.

Specific examples of each substituent in formula (2) are shown below.

(i) Examples of R are shown below:

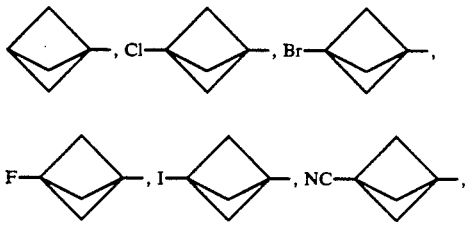

-continued

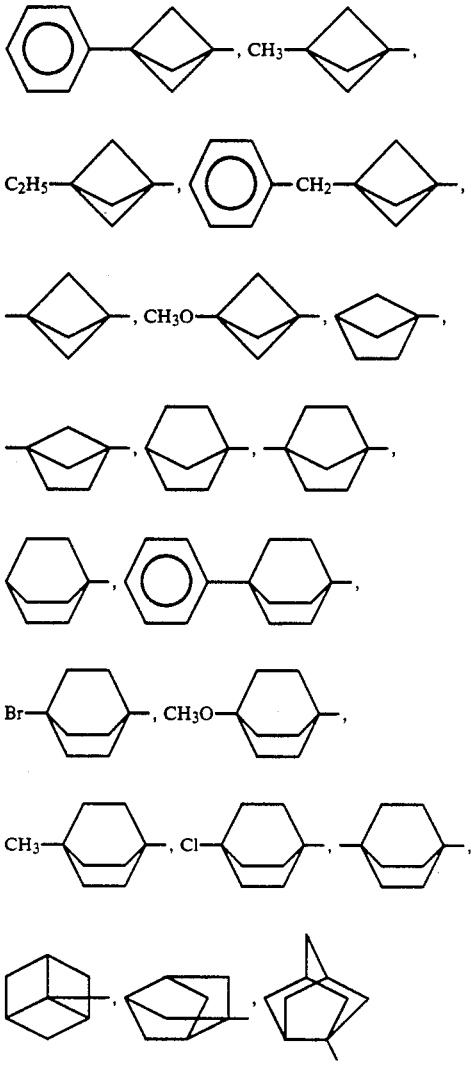

(ii) Examples of $R^3$ are shown below:

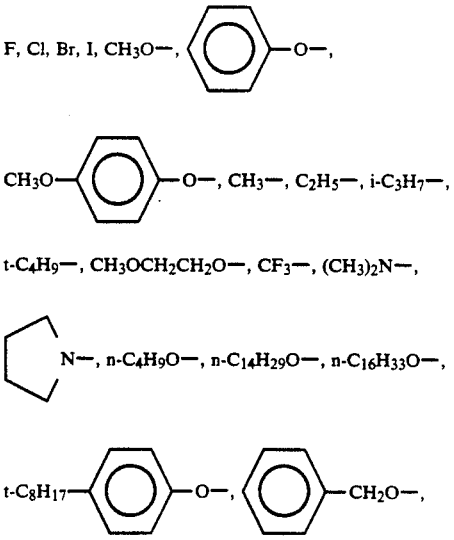

-continued $n\text{-}C_{12}H_{25}O-$, $C_{10}H_{21}CH(C_8H_{17})CH_2O-$ (iii) Examples of $R^4$ are shown below:

F, Cl, Br, I, $-OCH_3$, $-OC_{12}H_{25}$, $-OC_{16}H_{33}$, $-COOCH_3$, $-COOC_{12}H_{25}$, $-COOCH(CH_3)COOC_{12}H_{25}$,

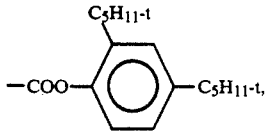

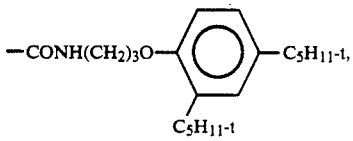

$-SO_2NH(CH_2)_3OC_{12}H_{25}$, $-SO_2N(C_8H_{17})_2$, $-SO_2N(CH_3)_2$, $-SO_2NHCOC_2H_5$, $-NHCOC_{13}H_{27}$, $-NHCOCH(C_6H_{13})C_8H_{17}$,

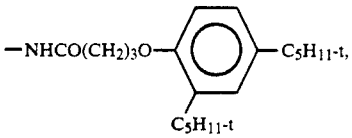

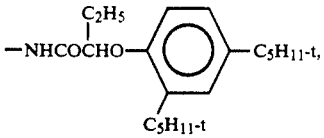

$-NHCOCH(CH_3)CH_2SO_2C_{12}H_{25}$, $-NHSO_2C_{16}H_{33}$,

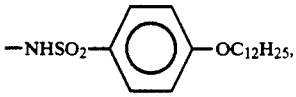

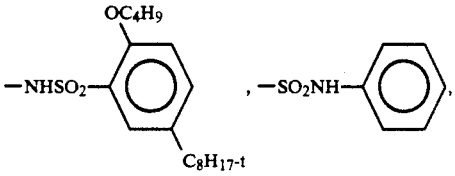

$-SO_2NHC_3H_7\text{-}i$, $-OCOC_{15}H_{31}$, $-OSO_2C_{16}H_{33}$, $-SO_2OC_{12}H_{25}$, $-NHCOOC_{12}H_{25}$, -continued

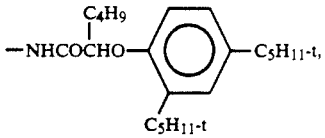

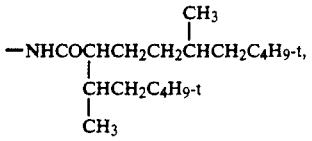

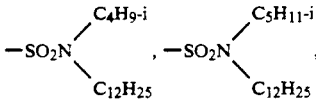

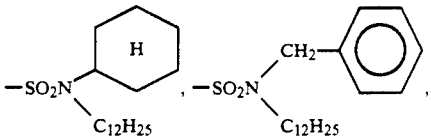

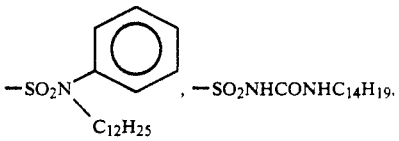

$-SO_2N(C_{12}H_{25})$, $-SO_2NHCONHC_{14}H_{19}$,

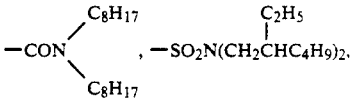

$-NHSO_2CH_3$, $-OCH_2COOC_{12}H_{25}$, $-CN$ (iv) Examples of X are shown below:

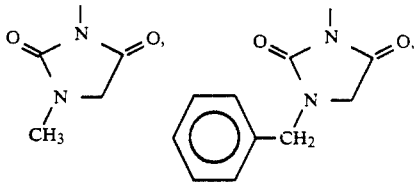

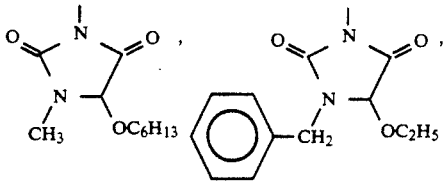

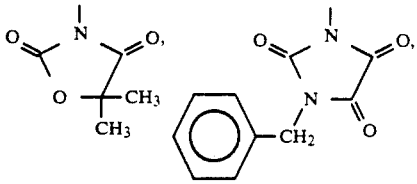

-continued
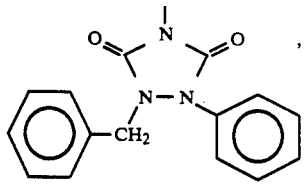
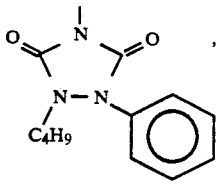
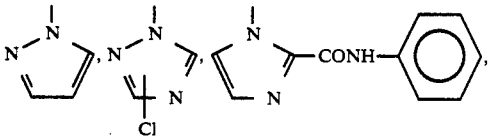
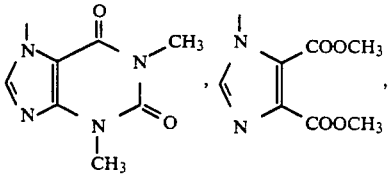
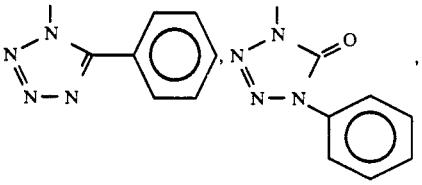
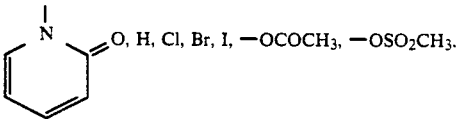
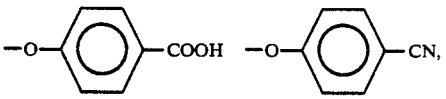
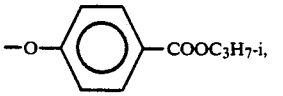
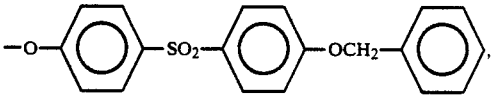
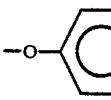
-continued
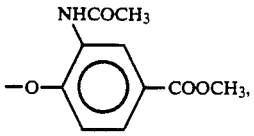
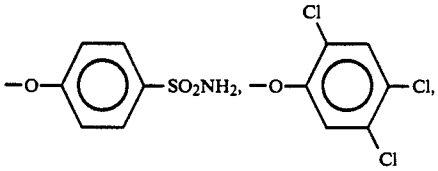
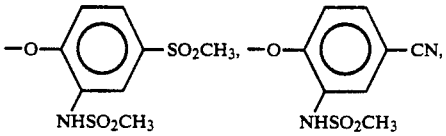
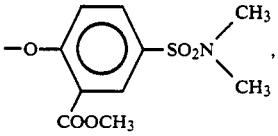
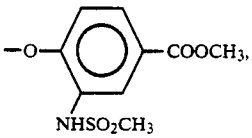
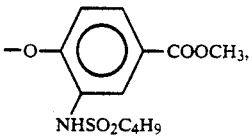
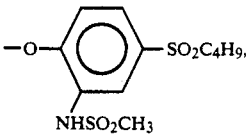
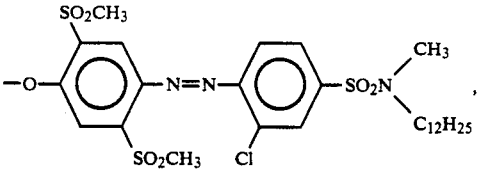
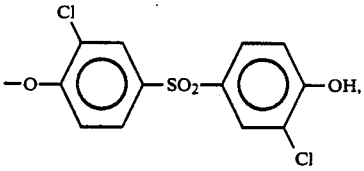
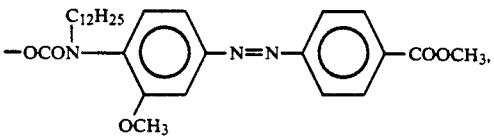

-continued
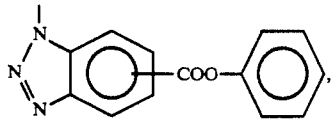
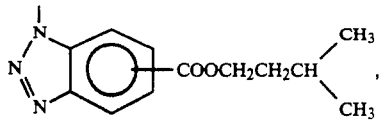
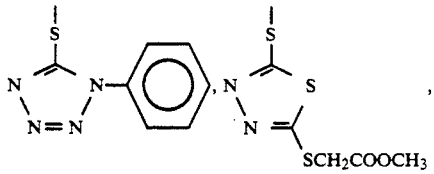
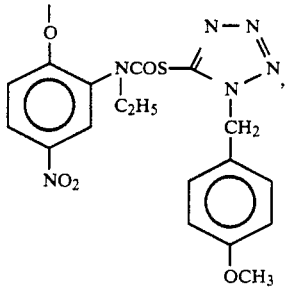
-continued
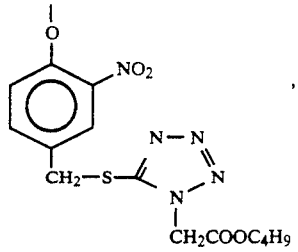
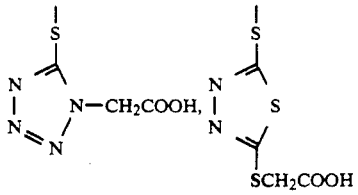
Specific examples (1) to (49) of the yellow coupler according to the present invention are shown below, but the present invention is not limited to these.
(1)
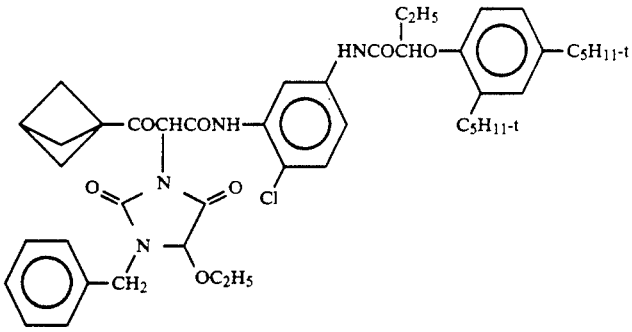
(2)
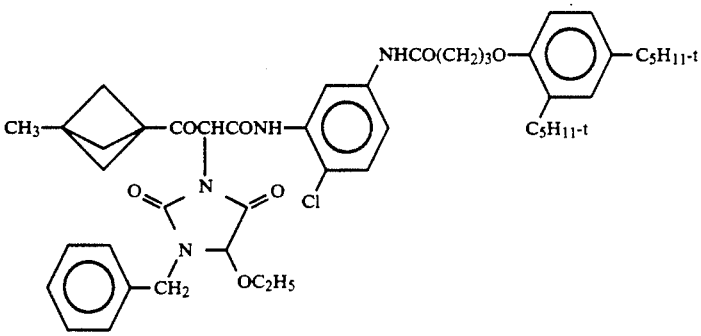

-continued
(3)
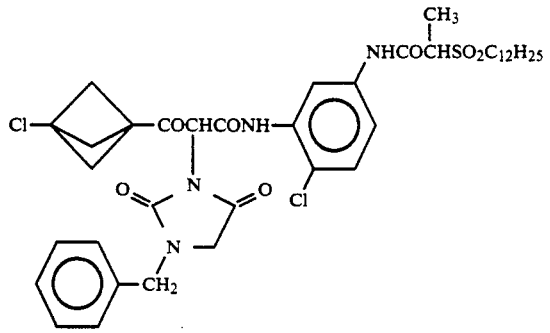
(4)
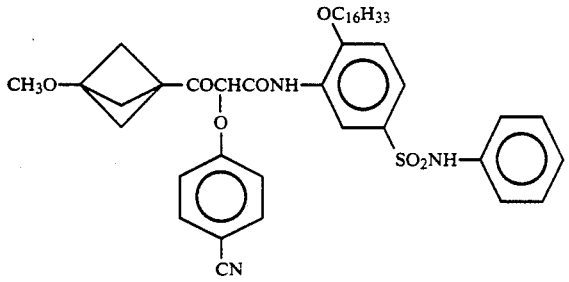
(5)
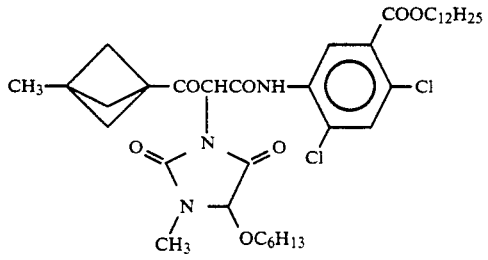
(6)
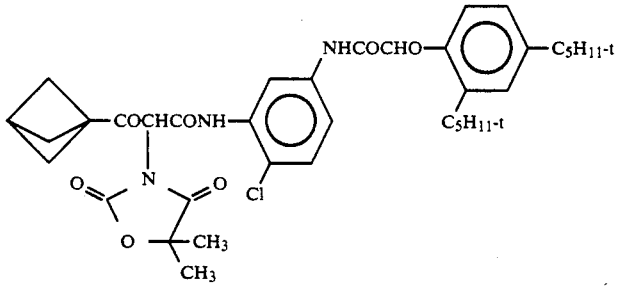
(7)
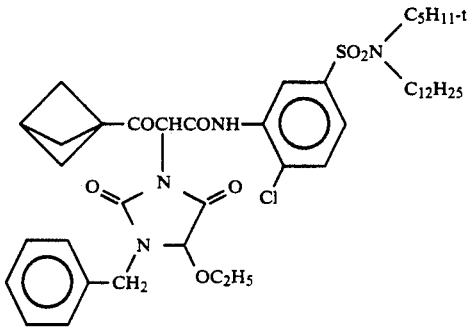

-continued
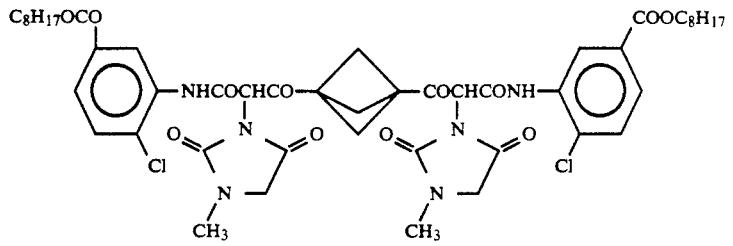
(8)
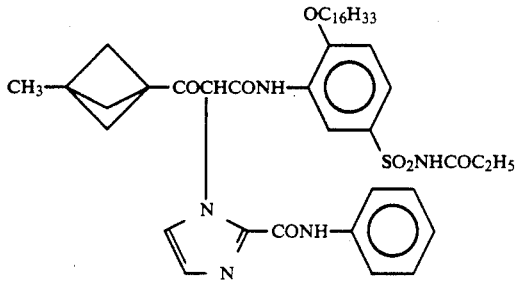
(9)
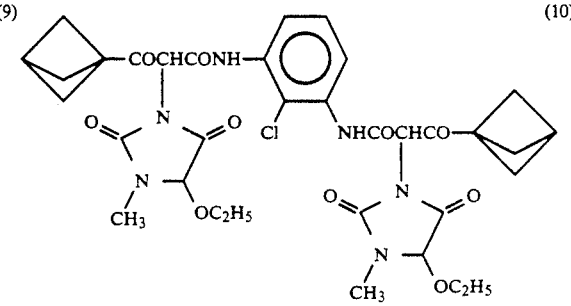
(10)
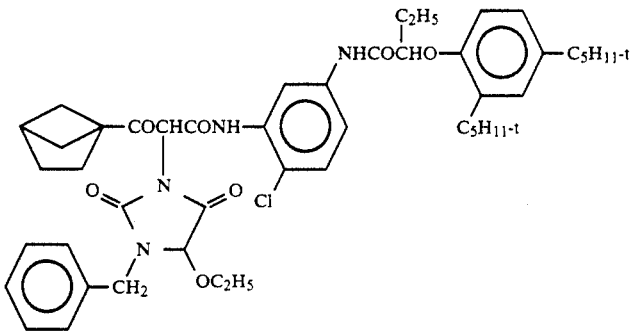
(11)
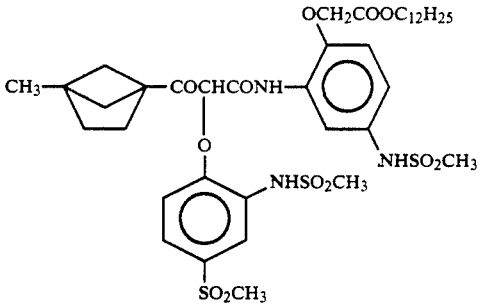
(12)
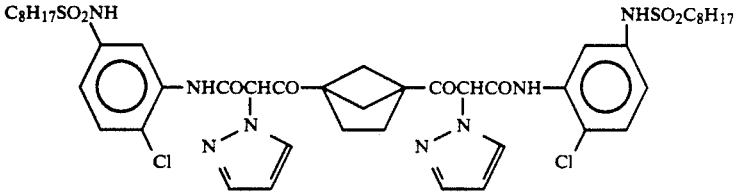
(13)

-continued
(14)
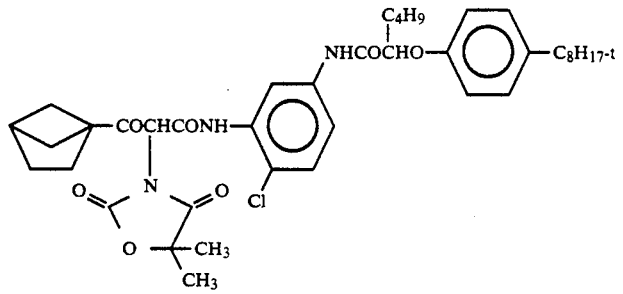
(15)
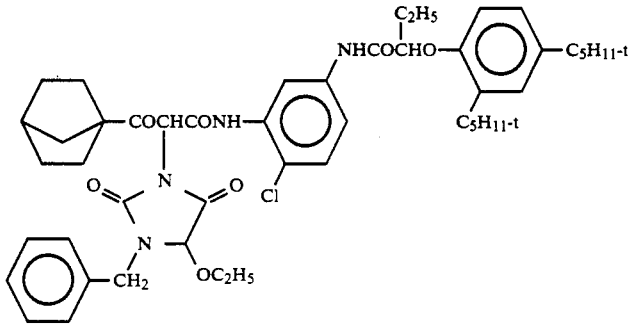
(16)
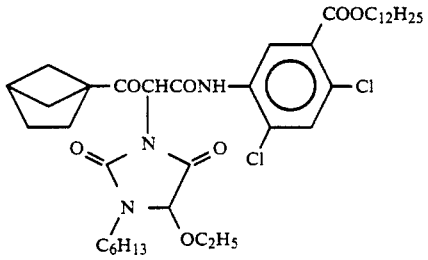
(17)
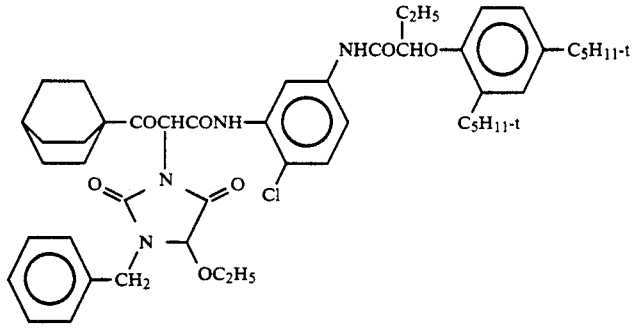
(18)
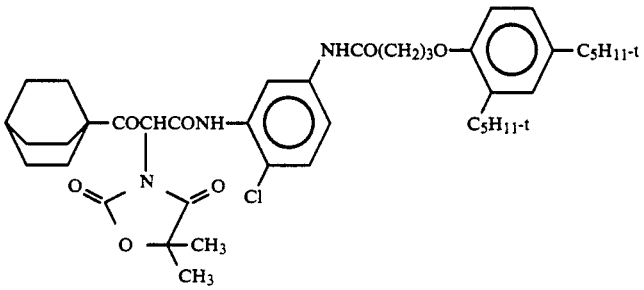

-continued
(19)
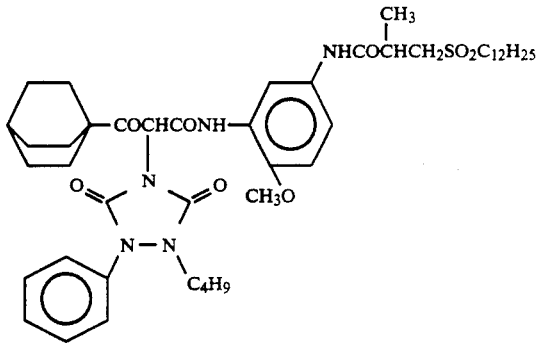
(20)
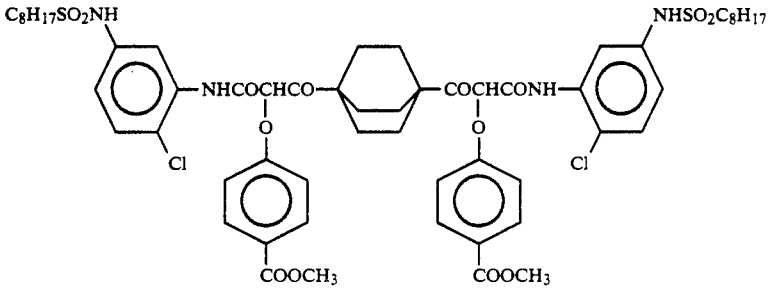
(21)
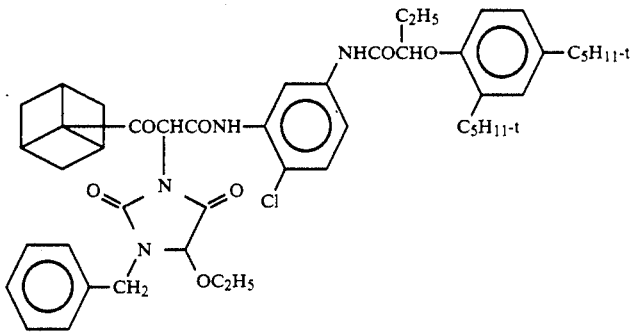
(22)
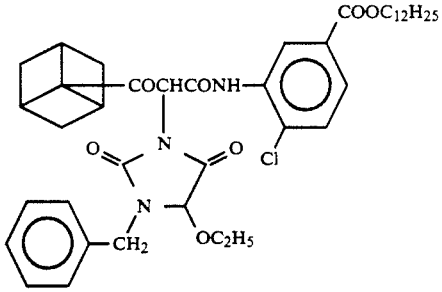
(23)
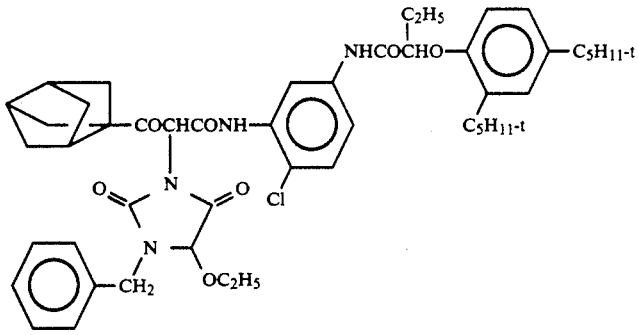

-continued
(24)
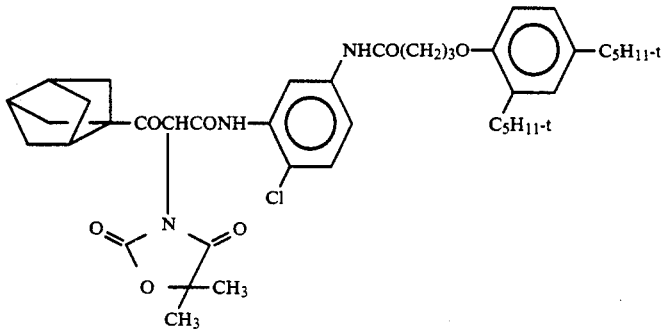
(25)
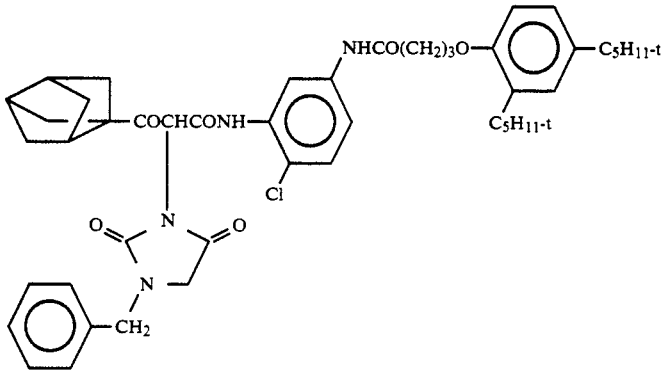
(26)
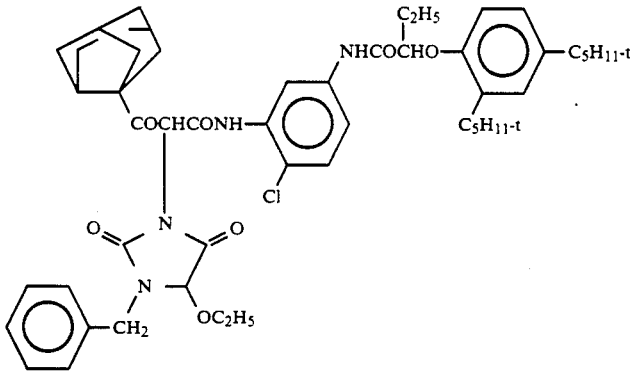
(27)
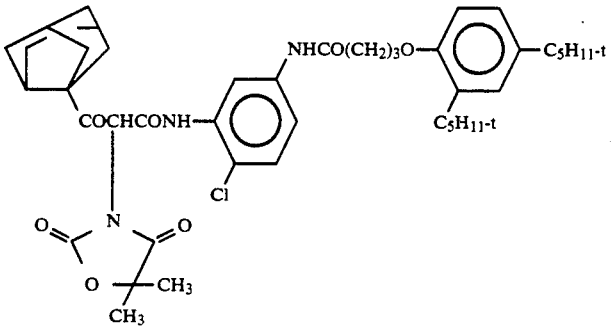

-continued
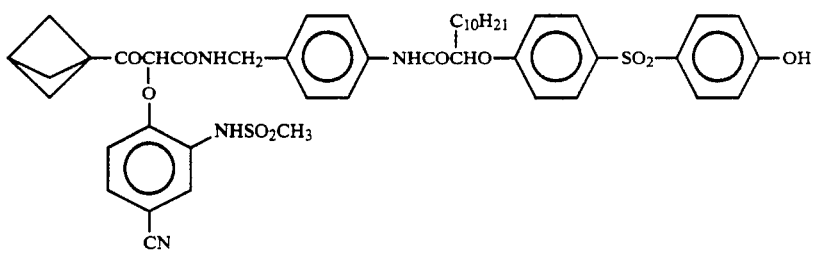
(28)
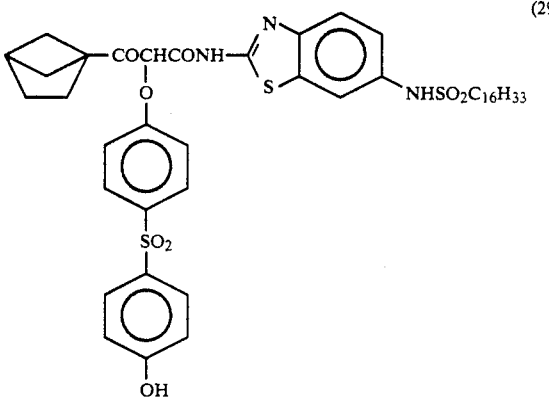
(29)
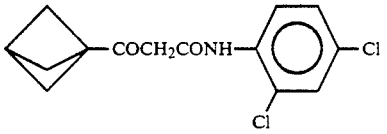
(30)
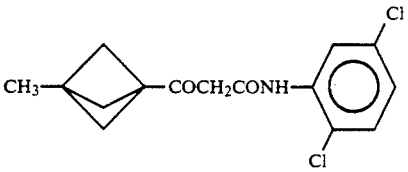
(31)
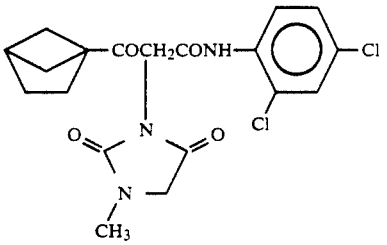
(32)
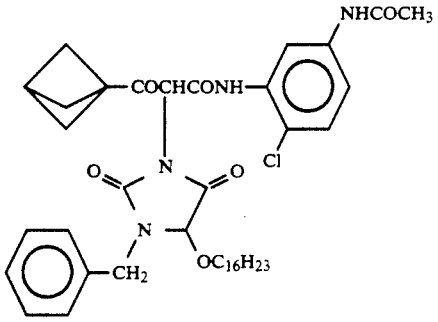
(33)
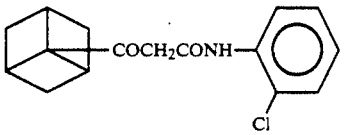
(34)

-continued
(35)
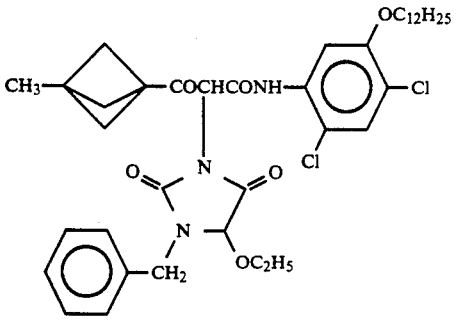
(36)
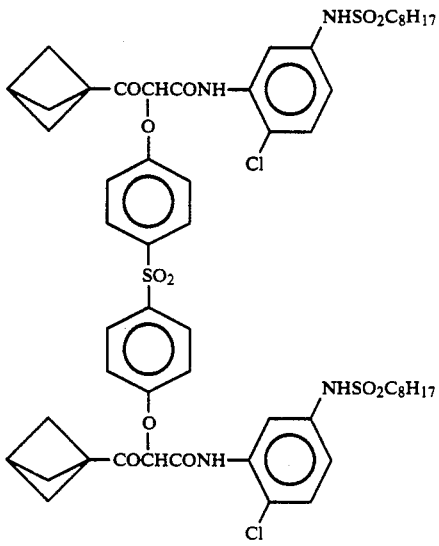
(37)
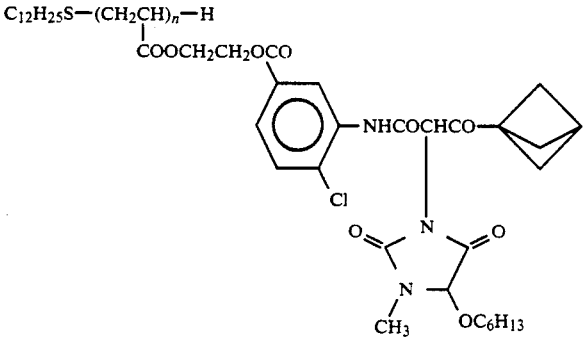
n = 3 (mean value)
(38)
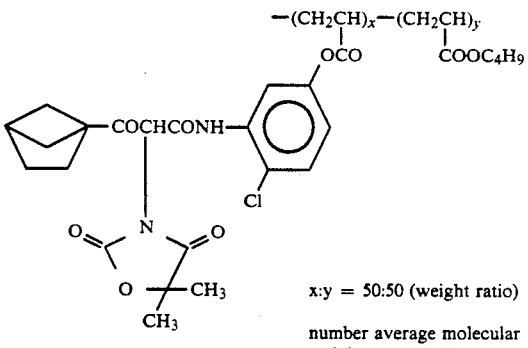
x:y = 50:50 (weight ratio)
number average molecular weight about 50,000
(39)
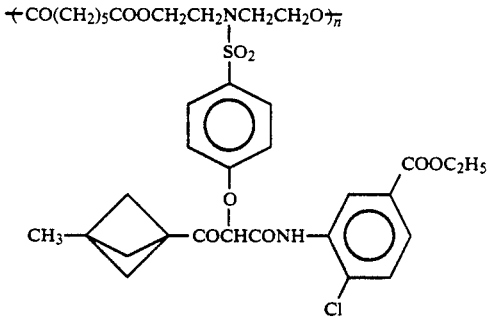
number average molecular weight about 30,000
(40)
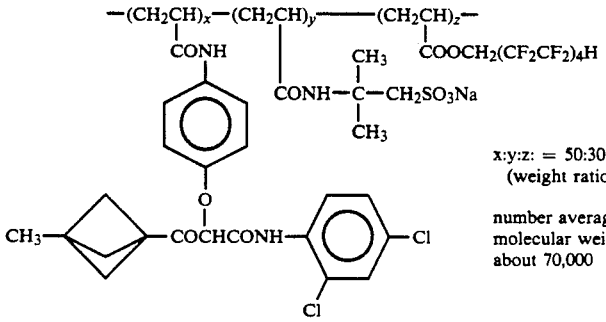
x:y:z: = 50:30:20 (weight ratio)
number average molecular weight about 70,000

-continued
(41)
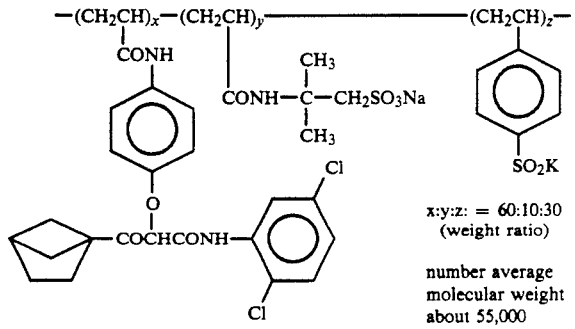
(42)
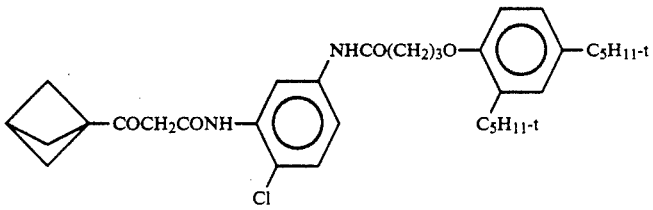
(43)
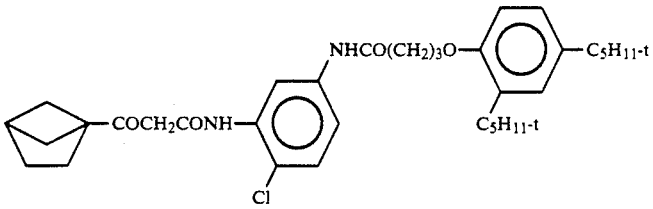
(44)
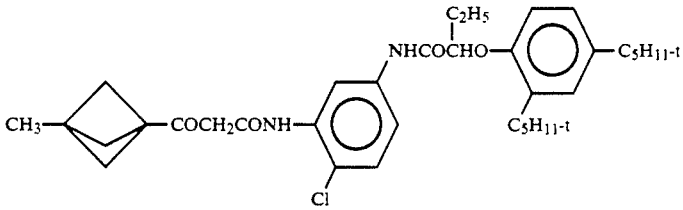
(45)
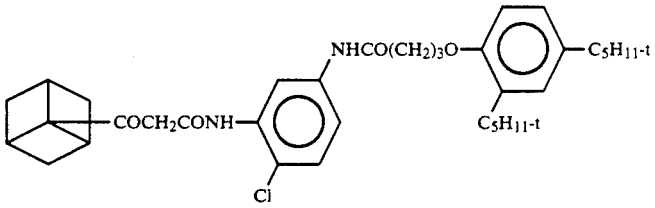
(46)
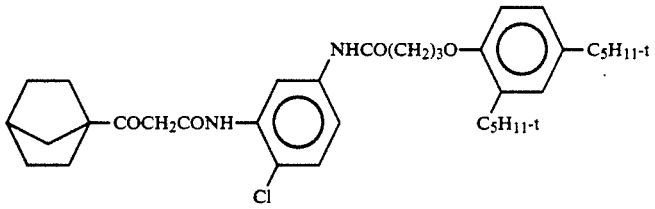
(47)
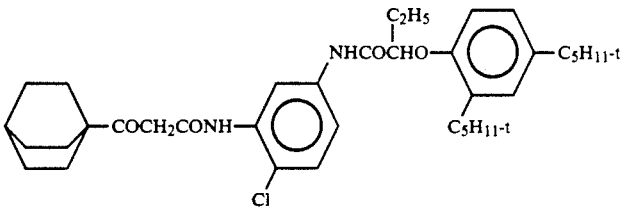

-continued (48)

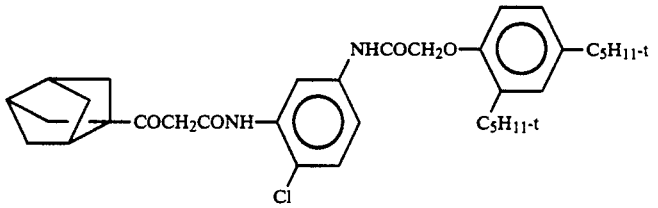

(49)

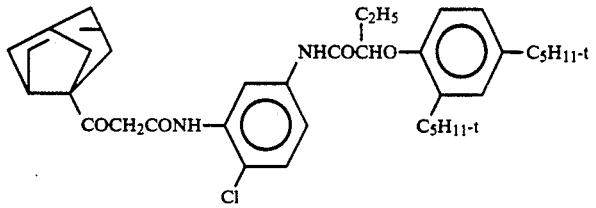

A yellow coupler represented by formula (1) of the present invention can be synthesized in accordance with the following synthetic route:

Synthetic Route

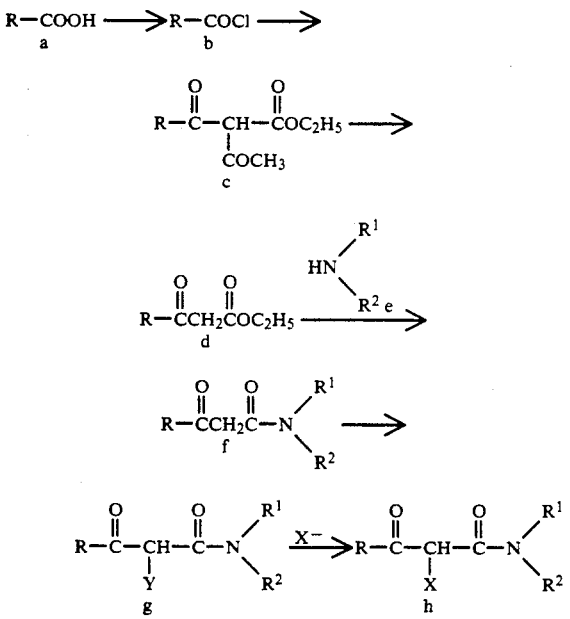

A compound a can be synthesized in accordance with a conventional known synthesis method. Typical synthesis methods are described in the following references:

K. B. Wiberg et al., J. Org. Chem. 1970, 35, 369,

K. B. Wiberg et al., J. Am. Chem. Soc., 1963, 85, 3188,

J. D. Roberts et al., J. Am. Chem. Soc., 1953, 75, 637,

P. L. Bixler et al., J. Org. Chem., 1958, 80, 248,

J. M. Harless et al., J. Am. Chem. Soc. 1977, 99, 2690, and

B. R. Vogt et al., Tetrahedron Lett., 1967, 2841.

The synthesis of the compound b is performed by using, e.g., thionyl chloride or oxalyl chloride in the absence of a solvent or in a solvent such as methylene chloride, chloroform, carbon tetrachloride, dichloroethane, toluene, N,N-dimethylformamide, or N,N-dimethylacetamide. The reaction temperature is, usually, −20° C. to 150° C., and preferably −10° C. to 80° C.

The compound c is synthesized by converting ethyl acetoacetate into an anion by using, e.g., magnesium methoxide and adding the compound b to the anion. The reaction is performed in the absence of a solvent or by using tetrahydrofuran or ethylether, and the reaction temperature is normally −20° C. to 60° C., and preferably −10° C. to 30° C. The compound d is synthesized by reacting the compound c with a base, such as ammonia water, an aqueous $NaHCO_3$ solution, or an aqueous sodium hydroxide solution, in the absence of a solvent or in a solvent such as methanol, ethanol, tetrahydrofuran, or acetonitrile. The reaction temperature is normally −20° C. to 50° C., and preferably −10° C. to 30° C.

The compound f is synthesized by reacting the compounds d and e in the absence of a solvent or in a hydrocarbon-based solvent. The reaction temperature is normally 100° C. to 200° C., and preferably 120° C. to 160° C. If X is not H, the split-off group X is introduced to finally synthesize the compound h after chlorination or bromination. The compound f is formed into a chloro-substituted form g by using, e.g., sulfuryl chloride or N-chlorosuccinimide or into a bromo-substituted form g by using, e.g., bromine or N-bromosuccinimide, in a solvent such as dichloroethane, carbon tetrachloride, chloroform, methylene chloride, or tetrahydrofuran. At this time, the reaction temperature is −20° C. to 70° C., and preferably −10° C. to 50° C.

Coupler h of the present invention can be obtained by reacting the chloro- or bromo-substituted product g with a proton adduct H—X of the split-off group in a solvent such as methylene chloride, chloroform, tetrahydrofuran, acetone, acetonitrile, dioxane, N-methylpyrrolidone, N,N'-dimethylimidazolidine-2-one, N,N-dimethylformamide, or N,N-dimethylacetamide at a reaction temperature of −20° C. to 150° C., and preferably −10° C. to 100° C. At this time, it is possible to use a base such as triethylamine, N-ethylmorpholine, 1,8-diazabicyclo[5.4.0]undec-7-ene (DBU), tetramethylguanidine, potassium carbonate, sodium hydroxide, or sodium bicarbonate.

The β-ketoester product d can also be synthesized in accordance with the following method.

Alternative Synthetic Method for d

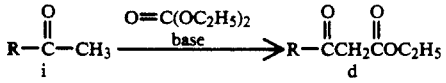

The β-ketoester product d can be obtained by reacting the ketone product i and diethyl carbonate in the presence of a base (for example, NaH, $NaNH_2$, t-butoxy potassium, or sodium ethylate), in the absence of a solvent, or in a solvent such as tetrahydrofuran, dioxane, toluene, xylene, tetralin, or ether. The reaction temperature is 0° C. to 200° C., and preferably 50° C. to 150° C. Diethyl carbonate and the base are, preferably, excessively used with respect to the ketone product i.

Synthesis examples of the couplers of the present invention will be described below.

SYNTHESIS EXAMPLE 1 SYNTHESIS OF EXEMPLIFIED COUPLER (49)

18.4 g of oxalylchoride were added dropwise in a mixture of 20 g of tricyclo[3.3.1.0$^{3,7}$]nonane-3-carboxylic acid (noradamantane-3-carboxylic acid) synthesized by the synthesis method described in B. R. Vogt et al., Tetrahedron Lett. 1967, 2841, 1 ml of N,N-dimethylformamide, and 100 ml of methylene chloride, at room temperature over 30 minutes under stirring. After the addition, the resultant mixture was stirred for two hours and was concentrated under reduced pressure to obtain 22 g of acid chloride.

80 ml of methanol were added dropwise in a mixture of 2.9 g of magnesium and 1.2 ml of carbon tetrachloride at room temperature over 30 minutes, and the mixture was refluxed under heating for two hours. 14.8 g of ethyl acetoacetate were added dropwise over 30 minutes, and the mixture was refluxed under heating for two hours. After the methanol was fully distilled off under reduced pressure, 200 ml of tetrahydrofuran were added in the mixture, and 22 g of the acid chloride obtained above were added dropwise at room temperature over 30 minutes under stirring. After the addition, the resultant mixture was stirred for 30 minutes, and 300 ml of ethyl acetate were added thereto. The reaction mixture was washed with diluted sulfuric acid water and then with water. The organic layer was dried over angydrous sodium sulfate, and then was concentrated under reduced pressure to obtain 34.4 g of an oily product. All the oily product was dissolved in 100 ml of ethanol, and 40 ml of 30% ammonium water were added dropwise therein at room temperature over 10 minutes. Thereafter, the resultant mixture was stirred for an hour, and 300 ml of ethyl acetate were added thereto. The reaction mixture was extracted and washed with diluted sulfuric acid water and then with water. The organic layer was dried over anydrous sodium sulfate and concentrated under reduced pressure to obtain 27.2 g of an oily product of ethyl tricyclo[3.3.1.0$^{3,7}$]nonane-3-carbonylacetate (β-ketoester product).

13.6 g of the β-ketoester product and 17.0 g of N-(3-amino-4-chlorophenyl)-2-(2,4-di-t-pentylphenoxy)-butaneamide were stirred under heating at a temperature of 140° C. under reduced pressure obtained by an aspirator for six hours. The reaction solution was purified by column chromatography using silica gel as a carrier and a solvent mixture of ethyl acetate and n-hexane as a developing liquid to obtain 24.8 g of a viscous oily product of the target exemplified coupler (49). The structure of the compound was confirmed by a MASS spectrum, an NMR spectrum, and elemental analysis.

SYNTHESIS EXAMPLE 2 SYNTHESIS OF EXEMPLIFIED COUPLER (26)

17.4 g of exemplified coupler (49) were dissolved in 200 ml of methylene chloride, and 4.1 g of sulfuryl chloride were added dropwise under ice cooling over 10 minutes. After the reaction was continued for 30 minutes, the reaction solution was washed well with water. The resultant solution was dried over anhydrous sodium sulfate and concentrated to obtain a chloride of exemplified coupler (49). This chloride of exemplified coupler (49) was dissolved in 50 ml of N,N-dimethylformaldehyde, and the resultant solution was added dropwise in a solution of 12.8 g of 1-benzyl-5-ethoxyhydantoin, 7.6 ml of triethylamine, and 50 ml of N,N-dimethylformamide at room temperature over 30 minutes.

Thereafter, the reaction was continued at 40° C. for four hours, and the reaction solution was extracted with 300 ml of ethyl acetate. After washing with water, the resultant material was washed with 300 ml of a 2% aqueous triethylamine solution and neutralized with diluted hydrochloric acid. After the organic layer was dried over angydrous sodium sulfate, the solvent was distilled off to obtain an oily product. This oily product was separated and purified by column chromatography using silica gel as a carrier and a solvent mixture of ethyl acetate and n-hexane as a developing liquid. The desired fraction was concentrated under reduced pressure to obtain 18.4 g of a viscous oily product of exemplified coupler (26) The structure of the compound was confirmed by a MASS spectrum, an NMR spectrum, and elementary analysis.

SYNTHESIS EXAMPLE 3 SYNTHESIS OF EXEMPLIFIED COUPLER (1)

12.3 g of a viscous oily product of exemplified coupler (1) were obtained following the same procedures as in synthesis examples 1 and 2, except that 13.5 g of bicyclo[1.1.1]pentane-1-carboxylic acid synthesized by the method described in K. B. Wiberg et al., J. Org. Chem., 1970, 35, 369 were used in place of tricyclo[3.3.1.03,7]nonane-3-carboxylic acid in synthesis example 1. The structure of the compound was confirmed by a MASS spectrum, an NMR spectrum, and elemental analysis.

SYNTHESIS EXAMPLE 4 SYNTHESIS OF EXEMPLIFIED COUPLER (11)

12.9 g of a viscous oily product of exemplified coupler (11) were obtained following the same procedures as in synthesis examples 1 and 2, except that 15.2 g of bicyclo[2.1.1]hexane-1-carboxylic acid synthesized by the method described in K. B. Wiberg et al., J. Amer. Chem. Soc., 1963, 85,3188 were used in place of tricyclo[3.3.1.03,7]nonane-3-carboxylic acid in synthesis example 1. The structure of the compound was confirmed by an MASS spectrum, an NMR spectrum, and elemental analysis.

The amount of the yellow coupler of the present invention falls within the range of 0.05 to 5.0 mmol/m$^2$, and more preferably 0.2 to 2.0 mmol/m$^2$.

The yellow coupler of the present invention may be used singly or used together with another yellow coupler (for example, a pivaloylacetanilide-type yellow coupler or a benzoylacetoanilide-type yellow coupler). When the coupler of the present invention is used in combination with another yellow coupler, the amount of the coupler of the present invention falls within the range of 10 mol % or more, and more preferably 40 mol % or more with respect to the total content of the yellow couplers.

In the light-sensitive material of the present invention, at least one of blue-, green-, and red-sensitive silver halide emulsion layers need only be formed on a support, and the number and order of the silver halide emulsion layers and non-light-sensitive layers are not particularly limited. A typical example is a silver halide photographic light-sensitive material having, on its support, at least one light-sensitive layer constituted by a plurality of silver halide emulsion layers which are sensitive to essentially the same color but have different sensitivities. This light-sensitive layer is a unit sensitive layer which is sensitive to one of blue light, green light, and red light. In a multilayered silver halide color photographic light-sensitive material, such unit light-sensitive layers are generally arranged in an order of red-, green-, and blue-sensitive layers from a support. However, in accordance with the application, this arrangement order may be reversed, or light-sensitive layers sensitive to the same color may sandwich another light-sensitive layer sensitive to a different color.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038. Further, it may contain a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the respective silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932 ("JP-B" means Published Examined Japanese Patent Application), layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as a middle layer, and a silver halide emulsion layer having sensitivity lower than that of the middle layer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

In addition, an order of high-sensitivity emulsion layer/low-sensitivity emulsion layer/medium-sensitivity emulsion layer, or low-sensitivity emulsion layer/medium-sensitivity emulsion layer/high-sensitivity emulsion layer may be adopted. Furthermore, the arrangement can be changed as described above even when four or more layers are formed.

In order to improve color reproducibility, a donor layer (CL) with an interlayer effect, which is described in U.S. Pat. No. 4,663,271, 4,705,744, or 4,707,436, JP-A-62-160448, or JP-A-63-89580 and different from the main light-sensitive layers BL, GL, and RL in spectral sensitivity distribution, is preferably formed adjacent to or close to the main light-sensitive layers.

As described above, various layer types and arrangements can be selected in accordance with the application of the light-sensitive material.

A preferable silver halide contained in photographic emulsion layers of the photographic light-sensitive material of the present invention is silver iodobromide, silver iodochloride, or silver iodochlorobromide, containing about 30 mol % or less of silver iodide. The most preferable silver halide is silver iodobromide or silver iodochlorobromide containing about 2 mol % to about 10 mol % of silver iodide Silver halide grains contained in the photographic emulsion may have a regular crystal structure such as a cubic, octahedral or tetradecahedral crystal structure or an irregular crystal structure such as a spherical or tabular crystals structure, or may have crystal defects such as twinned crystal faces. Silver halide grains having composite shapes thereof may also be used.

A silver halide may be of fine grains having a grain size of about 0.2 μm or less or large grains having a projected area diameter of up to about 10 μm, and the emulsion may be either a polydispersed or monodispersed emulsion.

A silver halide photographic emulsion which can be used in the light-sensitive material of the present invention can be prepared by methods described in, for example, "I. Emulsion preparation and types", Research Disclosure (RD) No. 17,643 (December, 1978), pp. 22 to 23, RD No. 18,716 (November, 1979), page 648 and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodispersed emulsions described in, for example, U.S. Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, pp. 248 to 257 (1970); U.S. Pat. Nos. 4,434,226, 4,414,310, 4,433,048, and 4,439,520, and British Patent 2,112,157.

A crystal structure may be uniform, may have different halogen compositions in the interior and the surface layer thereof, or may be a layered structure. Alternatively, a silver halide having a different composition may be bonded by an epitaxial junction or a compound except for a silver halide such as silver rhodanide or zinc oxide may be bonded. A mixture of grains having various types of crystal shapes may be used.

The above emulsion may be any of a surface latent image type emulsion which mainly forms a latent image on the surface of a grain, an internal latent image type emulsion which forms a latent image in the interior of a grain, and an emulsion of another type which has latent images on the surface and in the interior of a grain. However, the emulsion must be a negative type emulsion. In this case, the internal latent image type emulsion may be a core/shell internal latent image type emulsion described in JP-A-63-264740. A method of preparing this core/shell internal latent image type emulsion is described in JP-A-59-133542. Although the thickness of a shell of this emulsion depends on, e.g., development conditions, it is preferably 3 to 40 nm, and most preferably 5 to 20 nm.

A silver halide emulsion is normally subjected to physical ripening, chemical ripening, and spectral sensitization steps before it is used. Additives for use in these steps are described in Research Disclosure Nos. 17,643, 18,716, and 307,105, and they are summarized in the following table.

In the light-sensitive material of the present invention, it is possible to simultaneously use, in one layer, two or more types of emulsions different in at least one of characteristics of a light-sensitive silver halide emulsion, i.e., a grain size, a grain size distribution, a halogen composition, a grain shape, and a sensitivity.

Preferably, use may be made of surface-fogged silver halide grains described in U.S. Pat. No. 4,082,553, internally fogged silver halide grains described in U.S. Pat. No. 4,626,498 and JP-A-59-214852, and colloidal silver, in light-sensitive silver halide emulsion layers and/or essentially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852.

A silver halide which forms the core of an internally fogged core/shell type silver halide grain may have either a single halogen composition or different halogen compositions. As the internally fogged or surface-fogged silver halide, any of silver chloride, silver chlorobromide, silver bromoiodide, and silver bromochloroiodide can be used. Although the grain size of these fogged silver halide grains is not particularly limited, the average grain size is preferably 0.01 to 0.75 μm, and most preferably 0.05 to 0.6 μm. Since the grain shape is not particularly limited either, regular grains may be used. The emulsion may be a polydispersed emulsion but is preferably a monodispersed emulsion (in which at least 95% in weight or the number of grains of silver halide grains have grain sizes falling within a range of ±40% of an average grain size).

In the present invention, it is preferable to use a non-light-sensitive fine grain silver halide. The non-light-sensitive fine grain silver halide preferably consists of silver halide grains which are not exposed during imagewise exposure for obtaining a dye image and are not substantially developed during development. These silver halide grains are preferably not fogged in advance.

In the fine grain silver halide, the content of silver bromide is 0 to 100 mol %, and silver chloride and/or silver iodide may be added if necessary. The fine grain silver halide preferably contains 0.5 to 10 mol % of silver iodide.

The average grain size (average value of an equivalent-circle diameter of a projected area) of the fine grain silver halide is preferably 0.01 to 0.5 μm, and more preferably 0.02 to 0.2 μm.

The fine grain silver halide can be prepared following the same procedures as for a usual light-sensitive silver halide. In this case, the surface of each silver halide grain need not be optically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be preferably added to this fine grain silver halide grain-containing layer.

The silver coating amount of the light-sensitive material of the present invention is preferably 6.0 g/m$^2$ or less, and most preferably 4.5 g/m$^2$ or less.

Well-known photographic additives usable in the present invention are also described in the three Research Disclosures described above, and they are summarized in the following table.

| | Additives | RD17643 | RD18716 | RD307105 |
|---|---|---|---|---|
| 1 | Chemical sensitizers | page 23 | page 648, right column | page 866 |
| 2. | Sensitivity increasing agents | | page 648, right column | |
| 3. | Spectral sensitizers, super sensitizers | pages 23–24 | page 648, right column to page 649,right column | pages 866 to 868 |
| 4. | Brighteners | page 24 | | page 868 |
| 5. | Antifoggants and stabilizers | pages 24–25 | page 649, 649, right column | pages 868 to 870 |
| 6. | Light absorbent, filter dye, ultra-violet absorbents | pages 25–26 | page 649, right column to page 650, left column | page 873 |
| 7. | Stain peventing agents | page 25, right column | page 650, left to right columns | page 872 |
| 8. | Dye image stabilizer | page 25 | page 650, left column | page 872 |
| 9 | Hardening | page 26 | page 651, | pages 874 |

-continued

| | Additives | RD17643 | RD18716 | RD307105 |
|---|---|---|---|---|
| | agents | | left column | to 875 |
| 10. | Binder | page 26 | page 651, left column | pages 873 to 874 |
| 11. | Plasticizers, lubricants | page 27 | page 650, right column | page 876 |
| 12. | Coating aids, surface active agents | pages 26–27 | page 650, right column | pages 875 to 876 |
| 13. | Antistatic agents | page 27 | page 650, right column | pages 876 to 877 |
| 14. | Matting agent | | | pages 878 to 879 |

In order to prevent deterioration in photographic performance caused by formaldehyde gas, the light-sensitive material is preferably added with a compound described in U.S. Pat. No. 4,411,987 or 4,435,503, which can react with formaldehyde to fix it.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains a compound described in JP-A-1-106052, which releases a fogging agent, a development accelerator, a silver halide solvent, or a precursor of any of them, regardless of a developed amount of silver produced by development.

The light-sensitive material of the present invention preferably contains dyes dispersed by methods described in WO 88/04794 and JP-A-1-502912, or dyes described in EP 317,308A, U.S. Pat. No. 4,420,555, and JP-A-1-259358.

Various color couplers can be used in the present invention, and specific examples of these couplers are described in patents described in above-mentioned Research Disclosure No. 17643, VII-C to VII-G and No. 307105, VII-C to VII-G.

Preferred examples of a yellow coupler which can be used together with the coupler of the invention include those described above, and those described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,565,630, and WO No. 88/04795.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Laid-Open Patent Application (OLS) No. 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658. In addition, it is also possible to use pyrazoloazole couplers described in JP-A-64-553, JP-A-64-554, JP-A-64-555, and JP-A-64-556 or an imidazole coupler described in U.S. Pat. No. 4,818,672.

Typical examples of a polymerized dye-forming coupler are described in U.S. Pat. Nos. 3,451,820, 4,080,221, 4,367,288, 4,409,320, and 4,576,910, British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G and No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A57-154234, JP-A-60-184248, JP-A-63-37346, JP-A-63-37350, and U.S. Pat. Nos. 4,248,962 and 4,782,012.

Bleaching accelerator releasing couplers described in, e.g., RD Nos. 11449 and 24241 and JP-A-61-201247 can be effectively used to reduce a time required for a treatment having a bleaching function. This effect is notable especially when the coupler is added to a light-sensitive material using the tabular silver halide grains described above. Preferable examples of a coupler for imagewise releasing a nucleating agent or a development accelerator are described in British Patents 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with an oxidized form of a developing agent.

Examples of the other compounds which can be used in the light-sensitive material of the present invenion are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. Nos. 11,449 and 24,241 and JP-A-61-201247; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in, e.g., U.S. Pat. No. 2,322,027. Examples of a high-boiling organic solvent to be used in the oil-in-water dispersion method and having a boiling point of 175° C. or more at atmospheric pressure are phthalate esters (e.g., dibutyl phthalate, dicyclohexyl phthalate, di-2-ethylhexyl phthalate, decyl phthalate, bis(2,4-di-t-amyl phenyl)phthalate, bis(2,4-di-t-amylphenyl)isophthalate, and bis(1,1-di-ethylpropyl)phthalate), phosphates or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecyl benzoate, and 2-ethylhexyl p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxyic acid esters (e.g., bis(2-ethylhexyl) sebacate, dioctyl azelate, glycerol tributylate, isostearyl lactate, and trioctyl citrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethyl acetate, and dimethylformamide.

Steps and effects of a latex dispersion method and examples of an impregnating latex are described in, e.g., U.S. Pat. No. 4,199,363 and West German Patent Application (OLS) Nos. 2,541,274 and 2,541,230.

Various types of an antiseptic agent or a mildewproofing agent are preferably added to the color light-sensitive material of the present invention. Examples of the antiseptic agent and the mildewproofing agent are phenetyl alcohol, 1,2-benzisothiazoline-3-one, n-butyl p-hydroxybenzoate, 2-phenoxyethanol, and 2-(4-thiazolyl)benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 897.

In the light-sensitive material of the present invention, the sum total of film thicknesses of all hydrophilic colloidal layers on the side having emulsion layers is preferably 28 μm or less, more preferably 23 μm or less, most preferably 18 μm or less, and particularly preferably 16 μm or less. A film swell speed $T_{\frac{1}{2}}$ is preferably 30 sec. or less, and more preferably, 20 sec. or less. The film thickness means a film thickness measured under moisture conditioning at a temperature of 25° C. and a relative humidity of 55% (two days). The film swell speed $T_{\frac{1}{2}}$ can be measured in accordance with a known method in this field of art. For example, the film swell speed $T_{\frac{1}{2}}$ can be measured by using a swellometer described in Photogr. Sci Eng., A. Green et al., Vol. 19, No. 2, pp. 124 to 129. 90% of a maximum swell film thickness reached by performing a treatment with a color developing agent at 30° C. for 3 min. and 15 sec. is defined as a saturated film thickness, and $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with an equation: (maximum swell film thickness − film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material of the present invention can be developed by conventional methods described in RD. No. 17643, pp. 28 and 29, RD. No. 18716, page 615, the left to right columns, and RD No. 307105, pp. 880 and 881.

A color developer used in development of the light-sensitive material of the present invention is preferably an aqueous alkaline solution mainly containing an aromatic primary amine-based color developing agent. As this color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Of these compounds, 3-methyl-4-amino-N-ethyl-N-β-hydroxyethylaniline sulfate is most preferred. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye forming coupler; a competing coupler; an auxiliary developing agent such as 1-phenyl-3-pyrazolidone; a viscosity imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, an an aminophenol such as N-methyl-p-aminophenol can be used singly or in a combination of two or more thereof. The pH of the color and black-and-white developers is generally 9 to 12. Although the quantity of replenisher of these developers depends on a color photographic light-sensitive material to be processed, it is generally 3 liters or less per $m^2$ of the light-sensitive material. The quantity of replenisher can be decreased to be 500 ml or less by decreasing a bromide ion concentration in the replenisher. When the quantity of replenisher is decreased, a contact area of a processing tank with air is preferably decreased to prevent evaporation and oxidation of the replenisher upon contact with air.

A contact area of a photographic processing solution with air in a processing tank can be represented by an aperture defined below:

$$\text{Aperture} = \frac{\text{contact area (cm}^2\text{) of processing solution with air}}{\text{volume (cm}^3\text{) of processing solution}}$$

The above aperture is preferably 0.1 or less, and more preferably, 0.001 to 0.05. In order to reduce the aperture, a shielding member such as a floating cover may be provided on the liquid surface of the photographic processing solution in the processing tank. In addition, a method using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing storage of bromide ions in the developing solution.

A color development time is normally two to five minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a polyvalent metal metal such as iron(III); peroxides; quinones; and nitro compounds. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, JP-A-53-28426, and Research Disclosure No. 17,129 (July, 1978); a thiazolidine derivative described in JP-A-50-140129; a thiourea derivative described in JP-B-45-8506, JP-A-52-20832, JP-A-53-32735, and U.S. Pat. No. 3,706,561; iodide salts described in West German Patent, 1,127,715 and JP-A-58-16235; polyoxyethylene compounds descried in West German Patents 966,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxyacetic acid.

Examples of the fixing agent used in the fixing solution or the bleach-fixing slution are thiosulfate salt, a thiocyanate salt, a thioether-based compound, a thiourea and a large amount of an iodide. Of these compounds, a thiosulfate, especially, ammonium thiosulfate can be used in the widest range of applications. In addition, a combination of thiosulfate with a thiocyanate, a thioether-based compound, or thiourea is preferably used. As a preservative of the fixing solution or the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of strengthening the stirring are a method wherein a jet stream of the processing solution is allowed to collide against the emulsion surface of the light-sensitive material described in JP-A-62-183460, a method wherein the stirring effect is increased by using rotating means described in JP-A-62-183461, a method wherein the light-sensitive material is moved while the emulsion surface is brought into contact with a wiper blade provided in the solution to cause disturbance on the emulsion surface, thereby improving the stirring effect, and a method wherein the circulating flow amount in the overall processing solution is increased. Such a stirring improving means is effective in any of the bleaching solution, the bleach-fixing solution, and the fixing solution. It is assumed that the improvement in stirring increases the speed of supply of the bleaching agent and the fixing agent into the emulsion film, leading to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially a processing time in each processing step and reduces a processing solution replenishing amount.

The photographic light-sensitive material of the present invention is normally subjected to water washing and/or stabilizing steps after desilvering. An amount of water used in the washing step can be arbitrarily determined over a broad range in accordance with the properties (e.g., a property determined by the used materials such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazoles described in JP-A-57-8542, a chlorinebased germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct. Various chelating agents or antifungal agents can be added in the stabilizing bath.

An overflow solution produced upon washing and/or replenishment of the stabilizing solution can be reused in another step such as a desilvering step.

In the processing using, e.g., an automatic developing machine, if each processing solution described above is concentrated by evaporation, water is preferably added to correct concentration.

The silver halide color light-sensitive material of the present invention may contain a color developing agent in order to simplify processing and increase a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, e.g., U.S. Pat. No. 4,500,626, JP-A-60-133449, JP-A-59-218443, JP-A-61-238056, and EP 210,660A2.

The present invention will be described in more detail below by way of its examples, but the present invention is not limited to these examples.

The structures of comparative couplers used in the following examples are shown below:

Comparative couplers:

YC-1

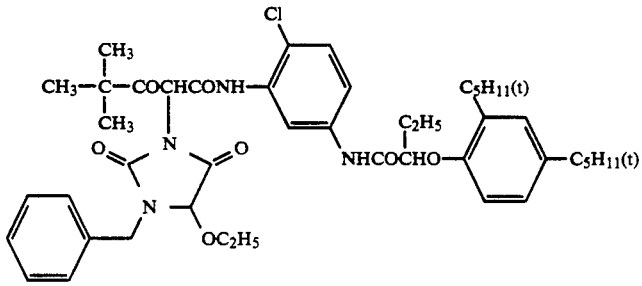

YC-2

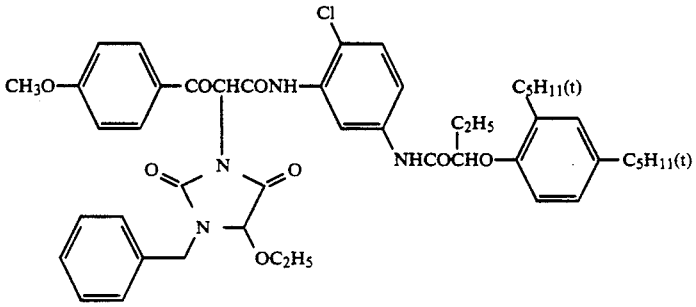

YC-3

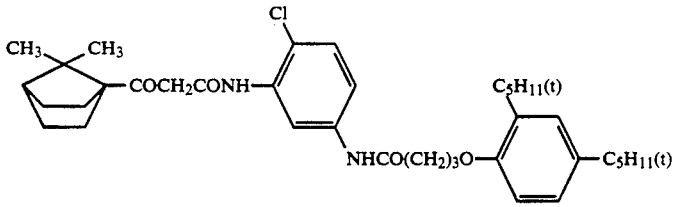

YC-4

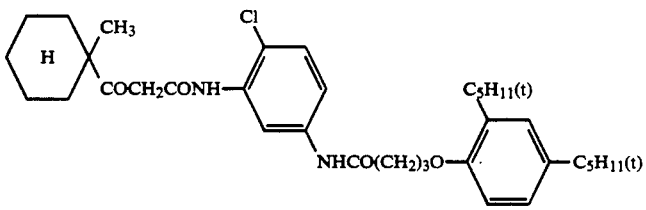

YC-5

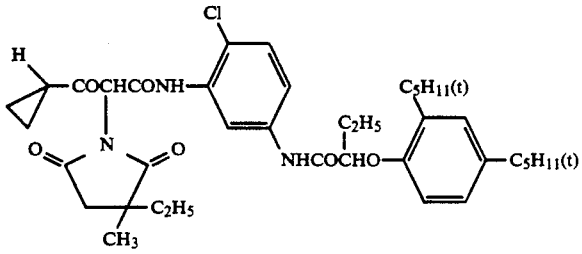

-continued
YC-6
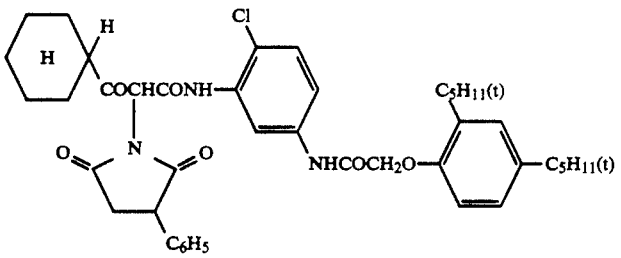
YC-7
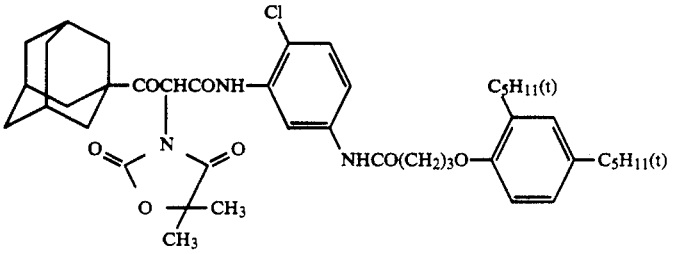
YC-8
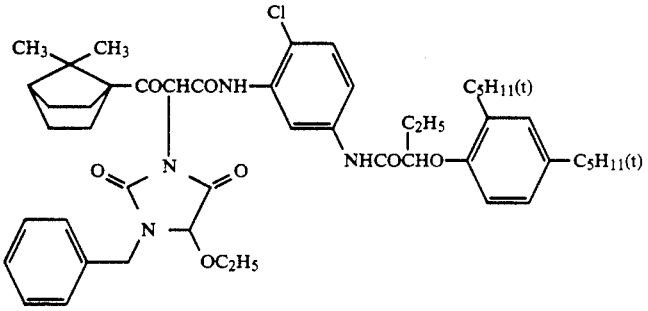
YC-9
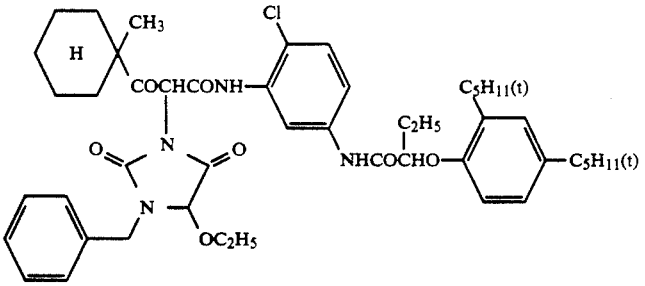
YC-10
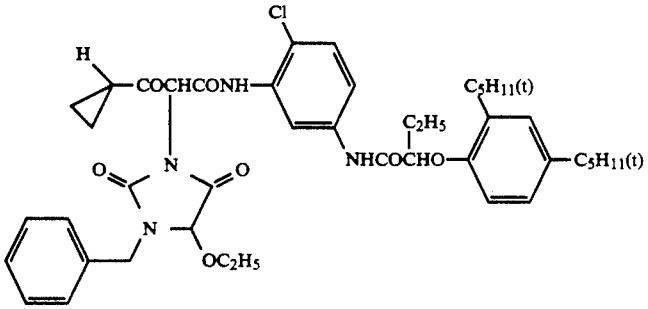

-continued

YC-11

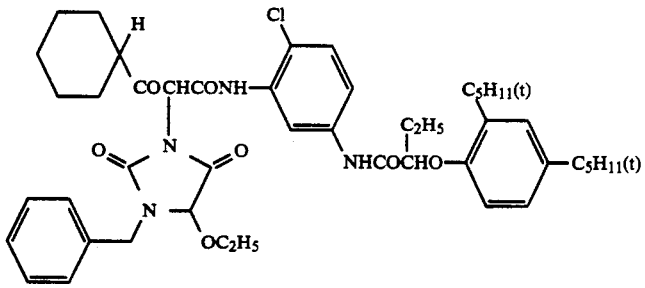

YC-12

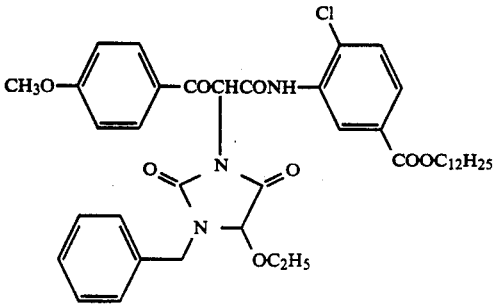

YC-13

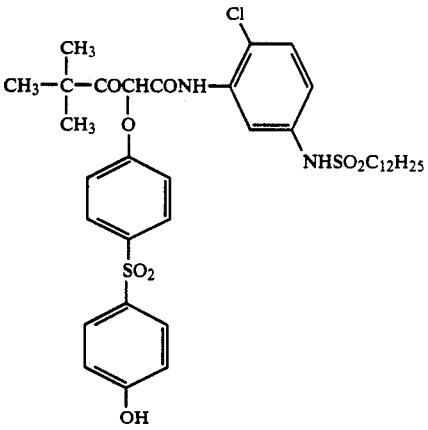

EXAMPLE 1

The comparative coupler YC-1 was weighed by 18.3 g, and was dissolved in 9.2 cc of tricresyl phosphate and 20 cc of ethyl acetate. 2.5 g of sodium dodecylbenzene sulfonate were added to 500 g of a 10% aqueous gelatin solution, and all the coupler solution was added thereto and emulsified and dispersed. A silver chlorobromide emulsion (silver bromide: 70 mol %) was added to this emulsified dispersion so that the molar ratio of the silver halide to the coupler was set to be 3.0. A 10% aqueous gelatin solution and water were added to the mixture so that the final amount of a coating solution was 2,000 cc and the final gelatin concentration was set to be 5%. This coating solution was applied to a subbed triacetyl cellulose support so that the coating amount of the coupler was set to be 1 mmol/m$^2$. A gelatin protective layer containing sodium 1-oxy-3,5-dichloro-s-triazinate as a hardening agent was simultaneously coated.

Other comparative couplers and the couplers of the present invention were used in an equimolar ratio in place of YC-1 following the same procedures as in Example 1.

These samples were subjected to sensitometry as follows. First, a sensitometer (FWH type available from Fuji Photo Film. Co. Ltd., color temperature of light source=3,200 K) was used to apply gradation exposure to each sample. The exposure in this case was performed with an exposure amount of 250 CMS for an exposure time of 0.1 sec. The exposed samples were subjected to the following processes in the steps of Table 1 below. The compositions of the respective processing solutions are summarized in Tables 2 and 3 below:

TABLE 1

| Processing step | Temperature | Time |
|---|---|---|
| Color Development | 35° C. | 2 min. |
| Bleach-fix | 35° C. | 1 min. 30 sec. |
| Washing with water | 35° C. | 2 min. |
| Drying | 60° C. | 10 min. |

TABLE 2

| Color developing solution | |
|---|---|
| Water | 700 ml |
| Ethylenediaminetetraacetic acid | 3.0 g |
| Triethanolamine | 12.0 g |
| Potassium bromide | 1.0 g |
| Potassium carbonate | 27.0 g |
| Sodium sulfite | 0.1 g |
| Disodium-N,N-bis(sulfonatoethyl) | 8.0 g |

TABLE 2-continued

| Color developing solution | |
|---|---|
| hydroxylamine N-ethyl-N-(β-methanesulfonamidoethyl)-3-methyl-4-aminoaniline sulfate | 5.0 g |
| Water to make | 1,000 ml |
| pH (25° C.) | 10.05 |

TABLE 3

| Bleach-fix solution | |
|---|---|
| Water | 600 ml |
| Ammonium thiosulfate (700 g/l) | 100 ml |
| Iron(III) ammonium ethylenediamine-tetraacetate | 55 g |
| Ethylenediaminetetraacetic acid | 5 g |
| Ammonium bromide | 40 g |
| Nitric acid (67%) | 30 g |
| Water to make | 1,000 ml |
| pH (25° C.) (by acetic acid or ammonia water) | 5.8 |

Maximum color forming densities Dmax were read from the sensitometric curves in blue ranges of the resultant samples. The optical image stabilities of the samples were evaluated by reading the ratios of remaining dye images at an initial density of 1.0 from the sensitometric curves upon radiation of the samples with 75,000-Lux xenon light for seven days. Discoloration values of the samples under humid/hot conditions were also read from the sensitometric curves after the samples were stored at a constant temperature of 60° C. and a constant humidity of 70%RH for three months. The results are summarized in Tables 4 and 5 below. A coupler having a higher Dmax can be regarded as an excellent coupler having a better color forming property. A coupler having a higher ratio of remaining dye image is regarded as an excellent coupler which causes less discoloration.

TABLE 4

| Coupler | Maximum Color Forming Density Dmax | Dye Image Stability (ratio of remaining dye image) Xenon Light Radiation | 60° C. - 70% | Remarks |
|---|---|---|---|---|
| YC-1 | 1.48 | 69% | 75% | Comparative Example Pivaloyl-type coupler |
| YC-2 | 1.75 | 31% | 46% | Benzoyl-type coupler |
| YC-3 | 0.69 | — | — | Coupler 29 described in US Re 27,848 |
| YC-4 | 0.87 | — | — | Coupler 30 described in US Re 27,848 |
| YC-5 | 1.32 | 9% | 10% | Coupler (19) described in JP-A-47-26133 |
| YC-6 | 1.02 | 17% | 13% | Coupler (21) described in JP-A-47-26133 |
| YC-7 | 1.27 | 86% | 84% | Coupler 2 described in JP-A-56-87041 |
| YC-8 | 1.36 | 80% | 79% | 2-equivalent coupler similar to YC-3 |

TABLE 4-continued

| Coupler | Maximum Color Forming Density Dmax | Dye Image Stability (ratio of remaining dye image) Xenon Light Radiation | 60° C. - 70% | Remarks |
|---|---|---|---|---|
| YC-9 | 1.17 | 75% | 81% | 2-equivalent coupler similar to YC-4 |
| YC-10 | 1.69 | 11% | 8% | Coupler similar to YC-5 |
| YC-11 | 1.52 | 16% | 15% | Coupler similar to YC-6 |

TABLE 5

| Coupler | Maximum Color Forming Density Dmax | Dye Image Stability (ratio of remaining dye image) Xenon Light Radiation | 60° C. - 70% | Remarks |
|---|---|---|---|---|
| (1) | 1.96 | 76% | 74% | Present invention |
| (2) | 1.92 | 74% | 77% | " |
| (11) | 1.87 | 78% | 78% | " |
| (15) | 1.62 | 85% | 83% | " |
| (17) | 1.55 | 87% | 84% | " |
| (21) | 1.82 | 73% | 75% | " |
| (23) | 1.52 | 94% | 91% | " |
| (24) | 1.61 | 92% | 87% | " |
| (26) | 1.54 | 93% | 90% | " |
| (27) | 1.63 | 90% | 87% | " |

As is apparent from Table 4, although a pivaloylacetanilide-type coupler represented by the comparative coupler YC-1 has a certain dye image stability or fastness, it does not have a sufficiently high maximum color forming density. A further improvement of this coupler is required. On other hand, although a benzoylacetanilide-type coupler represented by the comparative coupler YC-2 has a relatively high maximum color forming density, the dye image is greatly discolored upon light radiation or storage under humid/hot conditions. A further improvement of this coupler is also required.

The couplers represented by YC-3 to YC-11 are couplers described in U.S. Re 27,848, JP-A-47-26133, and JP-A-56-87041, or couplers similar to them. Either the maximum color forming density or dye image fastness of some of these couplers is better than that of YC-1 or YC-2. However, none of these couplers satisfy both the requirements of excellent color forming property and prevention of discoloration. Although the coupler YC-10 has a relatively high color forming density, the resultant dye image is orange in color; the coupler YC-10 is not preferred from the view point of color reproduction.

As shown in Table 5, the couplers (1), (2), (11), and (21) of the present invention have higher maximum color forming densities than that of the highly active benzoylacetanilide-type coupler (YC-2) and have equal or slightly better dye stability than the pivaloylacetanilide-type coupler (YC-1). Among the couplers (1), (2), (11), and (21), the couplers (1) and (2) exhibit higher maximum color forming densities.

On the other hand, the couplers (15), (17), (23), (24), (26), and (27) of the present invention have only slightly higher color forming densities than that of the pivaloylacetanilide-type coupler (YC-1). However, the couplers (15), (17), (23), (24), (26), and (27) have better dye stability than the coupler (YC-1) upon light radiation or storage under humid/hot conditions. Among these couplers, the couplers (23), (24), (26), and (27) have excellent dye stabilities.

As described above, the couplers of the present invention are regarded as excellent couplers having satisfactory, improved levels in both the color forming property and dye stability.

EXAMPLE 2

The comparative coupler YC-2 was weighed by 15.0 g, and was dissolved in 5.0 cc of tricresyl phosphate and 20 cc of ethyl acetate. 2.5 g of sodium dodecylbenzene sulfonate were added to 500 g of a 10% aqueous gelatin solution, and all the coupler solution was added thereto and emulsified and dispersed. A silver iodobromide emulsion (silver iodide: 8 mol %) was added to this emulsified dispersion so that the molar ratio of the silver halide to the coupler was set to be 4.0. A 10% aqueous gelatin solution and water were added to the mixture so that the final amount of a coating solution was 2,000 cc and the final gelatin concentration was set to be 5%. This coating solution was applied to a subbed triacetyl cellulose support so that the coating amount of the coupler was set to be 1 mmol/m$^2$. A gelatin protective layer containing 1,2-bis(vinylsulfonylacetamide)ethane as a hardening agent was simultaneously coated.

Other comparative couplers and the couplers of the present invention were used in an equimolar ratio in place of YC-2 following the same procedures as in Example 2.

These samples were subjected to sensitometry as follows. First, a sensitometer (FWH type available from Fuji Photo Film. Co. Ltd., color temperature of light source=3,200 K) was used to apply gradation exposure to each sample. The exposure in this case was performed with an exposure amount of 5 CMS for an exposure time of 0.1 sec. The exposed samples were subjected to the following processes in the steps of Table 6 below. The compositions of the respective processing solutions are summarized in Tables 7 to 9 below:

TABLE 6

| Processing Step | Temperature | Time |
|---|---|---|
| Color development | 38° C. | 3 min. 15 sec. |
| Bleaching | 38° C. | 6 min. 30 sec. |
| Washing with water | 38° C. | 2 min. |
| Fixing | 38° C. | 4 min. 30 sec. |
| Washing with water | 35° C. | 5 min. |
| Drying | 60° | 5 min. |

TABLE 7

| Color developer solution | |
|---|---|
| Water | 700 ml |
| Ethylenediaminetetraacetic acid | 2.0 g |
| Sodium sulfite | 4.0 g |
| Potassium carbonate | 30.0 g |
| Potassium bromide | 1.4 g |
| Hydroxylamine sulfate | 8.0 g |
| 4-(N-ethyl-N-(β-hydroxyethylamino)-2-methylaniline sulfate | 4.5 g |
| Water to make | 1,000 ml |

TABLE 7-continued

| Color developer solution | |
|---|---|
| pH (25° C.) | 10.05 |

TABLE 8

| Bleaching solution | |
|---|---|
| Water | 600 ml |
| Ammonium thiosulfate (700 g/l) | 100 g |
| Iron(III) sodium ethylenediamine-tetraacetate trihydrate | 100 g |
| Disodium ethylenediamine-tetraacetete | 10 g |
| Ammonium bromide | 30 g |
| Ammonia water (27%) | 6.5 ml |
| Water to make | 1,000 ml |
| pH (25° C.) | 6.0 |

TABLE 9

| Fixing solution | |
|---|---|
| Water | 600 ml |
| Disodium ethylenediamine-tetraacetate | 0.5 g |
| Sodium sulfite | 7.0 g |
| Sodium bisulfite | 5.0 g |
| Ammonium thiosulfate (700 g/l) | 170 ml |
| Water to make | 1,000 ml |
| pH (25° C.) (by acetic acid or ammonia water) | 6.7 |

Maximum color forming densities Dmax were read from the sensitometric curves in blue ranges of the resultant samples. The dye image stabilities of the samples were evaluated by reading the ratios of remaining dye images of the Dmax portions from the sensitometric curves after the samples were stored at a temperature of 60° C. and a humidity of 70%RH for 4 months. Results are summarized in Table 10. The couplers are regarded as excellent couplers having high maximum color forming densities and high ratios of remaining dye images.

TABLE 10

| Coupler | Maximum Color Forming Density Dmax | Dye Image Stability (ratio or remaining dye image) at 60° C. - 70% | Remarks |
|---|---|---|---|
| YC-2 | 1.72 | 68% | Comparative Example benzoyl-type coupler |
| YC-12 | 1.78 | 62% | Comparative Example benzoyl-type coupler |
| YC-13 | 1.49 | 62% | Comparative Example pivaloyl-type coupler |
| (1) | 1.97 | 87% | Present invention |
| (5) | 2.08 | 82% | " |
| (7) | 2.04 | 83% | " |
| (16) | 1.83 | 91% | " |
| (22) | 1.87 | 88% | " |

As is apparent from Table 10, the couplers of the present invention have higher color forming densities than that of the comparative couplers YC-2 and YC-12 as highly active benzoylacetanilide-type couplers and the comparative coupler YC-13 known as a relatively highly active coupler among pivaloylacetanilide-type couplers. The couplers of the present invention exhibit better results than the comparative couplers in discoloration of dye images upon storage under humid/hot conditions.

As described above, the couplers of the present invention are regarded as excellent couplers having satisfactory, improved levels in both the color forming property and dye stability.

EXAMPLE 3

The polyethylene-laminated surfaces of a paper support were subjected to corona discharge, a gelatin subbing layer containing sodium dodecylbenzene sulfonate was formed, and various photographic constituting layers were coated to prepare a multi-layered color photographic paper (sample 1) having the following layer structure. The coating solutions were prepared as follows.

Preparation of coating solution for fifth layer 2.0 g of the cyan coupler (ExC), 3.0 g of the dye image stabilizer (Cpd-2), 2.0 g of the dye image stabilizer (Cpd-4), 18.0 g of the dye image stabilizer (Cpd-6), 40.0 g of the dye image stabilizer (Cpd-7), and 5.0 g of the dye image stabilizer (Cpd-8) were dissolved in 50.0 cc of ethyl acetate and 14.0 g of a solvent (Solv-6). The resultant solution was added to 500 cc of a 20% aqueous gelatin solution containing 8 cc of sodium dodecylbenzene sulfonate. The mixture was emulsified and dispersed by an ultrasonic homogenizer to prepare an emulsified disperion. A silver chlorobromide emulsion (cubic, a 1:4 mixture (Ag molar ratio) of a large-size emulsion having an average grain size of 0.58 μm and a small-size emulsion having that of 0.45 μm. The variation coefficients of grain size distributions of the two emulsions were 0.09 and 0.11, respectively. Each emulsion locally contained 0.6 mol % of AgBr in a portion of the surface of each grain) was prepared. The following red-sensitive sensitizing dye E was added to the large-size emulsion in an amount of $0.9\times10^{-4}$ mol per mol of silver and to the small-size emulsion in an amount of $1.1\times10^{-4}$ mol per mol of silver. Chemical ripening of these emulsions was performed by adding a sulfur sensitizer and a gold sensitizer. This red-sensitive silver chlorobromide emulsion was mixed with and dissolved in the above emulsified dispersion, thereby preparing the coating solution of the fifth layer having a composition given below.

The coating solutions of the first to fourth layers and those of the sixth and seventh layers were prepared following the same procedures as in preparation of the coating solution of the fifth layer. H-1 and H-2 were used as gelatin hardening agents of the respective layers.

Cpd-10 and Cpd-11 were added to each layer so that the total content of the dye image stabilizers was 25.0 mg/m² and 50.0 mg/m², respectively.

Spectral sensitizing dyes shown in Tables 11 to 13 below were used to the silver chlorobromide emulsions of the respective light-sensitive emulsion layers.

TABLE 11

Blue-sensitive emulsion layer

Sensitizing dye A

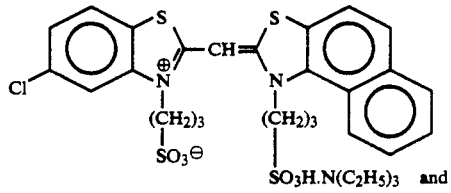

and

Sensitizing dye B

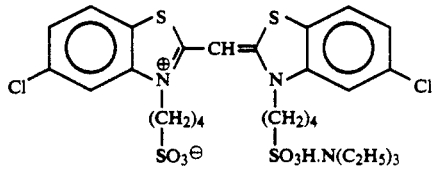

($2.0\times10^{-4}$ mol and $2.5\times10^{-4}$ mol respectively for large- and small-size emulsions per mol of the silver halide)

TABLE 12

Green-sensitive emulsion layer

Sensitizing dye C

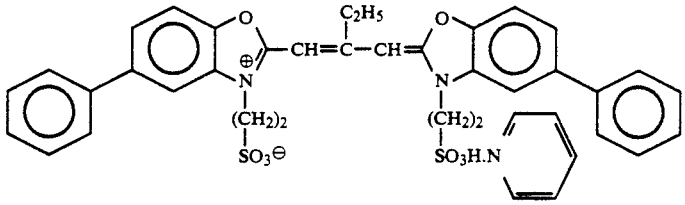

($4.0\times10^{-4}$ mol and $5.6\times10^{-4}$ mol respectively for large- and small-size emulsions per mol of the silver halide), and Sensitizing dye D

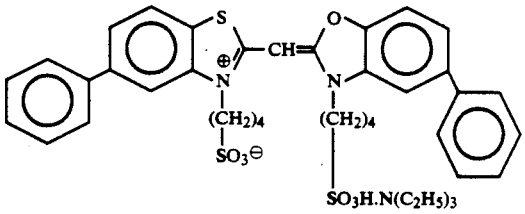

($7.0\times10^{-5}$ mol and $1.0\times10^{-5}$ mol respectively for large- and small-size emulsions per mol of the silver halide)

TABLE 13

Red-sensitive emulsion layer

Sensitizing dye E

TABLE 13-continued

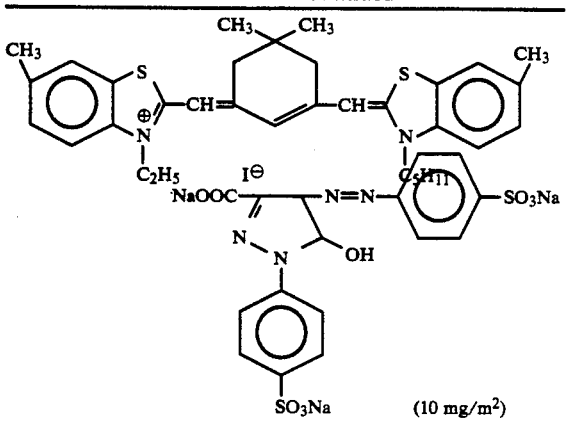

(10 mg/m²)

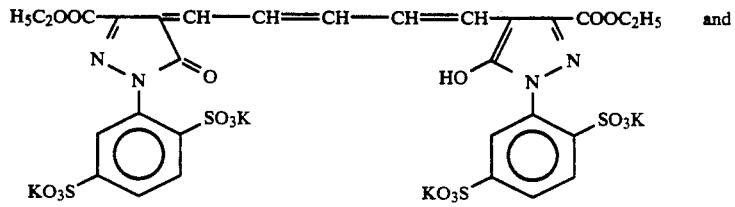

(40 mg/m²)

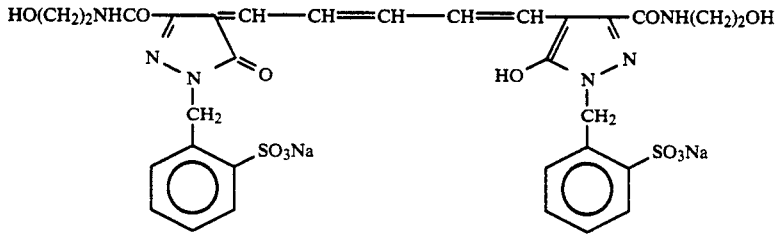

(20 mg/m²)

($0.9\times10^{-4}$ mol and $1.1\times10^{-4}$ mol respectively for large- and small-size emulsions per mol of the silver halide)

In addition, the following compound was added in an amount of $2.6\times10^{-3}$ per mol of the silver halide.

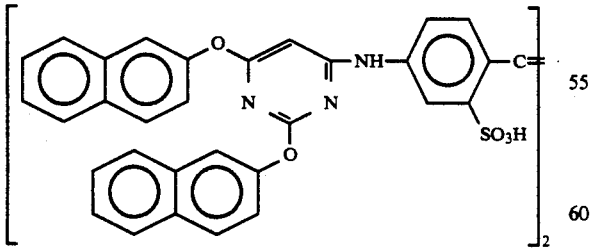

1-(5-methylureidophenyl)-5-mercaptotetrazole was added to the blue-, green-, and red-sensitive emulsion layers in amounts of $8.5\times10^{-5}$ mol, $7.7\times10^{-4}$ mol, and $2.5\times10^{-4}$ mol per mol of the silver halide, respectively.

4-hydroxy-6-methyl-1,3,3a,7-tetrazaindene were added in amounts of $1\times10^{-4}$ mol and $2\times10^{-4}$ mol per mol of the silver halide, respectively, to each of the blue- and green-sensitive emulsion layers.

In addition, the following dyes (coating amounts are represented in the parentheses) were added to the emulsion layers for anti-irradiation:

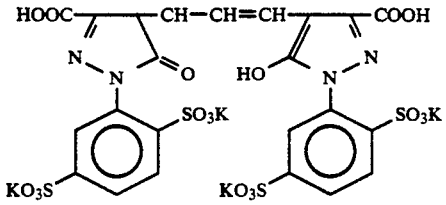

(10 mg/m²)

and (40 mg/m²)

(20 mg/m²)

Layer structure

Tables 14 to 17 show compositions of the prespective layers. Numbers represent coating amounts (g/m²). The amount of the silver halide emulsions is indicated as the coating amounts figured out as silver contents.

TABLE 14

| | |
|---|---|
| Support<br>Polyethylene laminated paper [containing a white pigment ($TiO_2$) and a blue dye (ultramarine blue) in the polyethylene on the first layer side] | |
| First Layer (Blue-sensitive emulsion layer) | |
| Silver chlorobromide emulsion (cubic, a 3:7 mixture (silver molar ratio) of a large-size emulsion having an average grain size of 0.88 μm and a small-size emulsion having that of 0.70 μm. The variation coefficients of grain size distributions of the two emulsions were 0.08 and 0.10, respectively. Each emulsion locally contained 0.3 mol% of silver bromide in a portion of the surface of each grain.) | 0.20 |
| Gelatin | 1.44 |
| Yellow coupler (ExY) | 0.48 |
| Dye image stabilizer (Cpd-1) | 0.15 |
| Solvent (Solv-3) | 0.12 |
| Solvent (Solv-7) | 0.12 |
| Dye image stabilizer (Cpd-7) | 0.04 |
| Dye image stabilizer (Cpd-9) | 0.03 |
| Stabilizer (Cpd-12) | 0.01 |

TABLE 15

| | |
|---|---|
| Second Layer (Color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third Layer (Green-sensitive emulsion layer) | |
| Silver chlorobromide emulsion (cubic, a 1:3 mixture (Ag molar ratio) of a large-size emulsion having an average grain size of 0.55 μm and a small-size emulsion having that of 0.39 μm. The variation coefficients of grain size distributions of the two emulsions were 0.10 and 0.08, respectively. Each emulsion locally contained 0.8 mol% of AgBr in a portion of the surface of each grain.) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |

TABLE 16

| | |
|---|---|
| Fourth Layer (Ultraviolet absorbing layer) | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| Fifth Layer (Red-sensitive emulsion layer) | |

TABLE 16-continued

| | |
|---|---|
| Silver chlorobromide emulsion (cubic, a 1:4 mixture (Ag molar ratio) of a large-size emulsion having an average grain size of 0.58 μm and a small-size emulsion having that of 0.45 μm. The variation coefficients of grain size distributions of the two emulsions were 0.09 and 0.11, respectively. Each emulsion locally contained 0.6 mol% of AgBr in a portion of the surface of each grain.) | 0.23 |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Dpd-7) | 0.40 |
| Dye image stabilizer (Cpd-8) | 0.05 |
| Solvent (Solv-6) | 0.14 |

TABLE 17

| | |
|---|---|
| Sixth Layer (Ultraviolet absorbing layer) | |
| Gelatin | 0.53 |
| Ultraviolet absorbent (UV-1) | 0.16 |
| Color mixing inhibitor (Cpd-5) | 0.02 |
| Solvent (Solv-5) | 0.08 |
| Seventh Layer (Protective layer) | |
| Gelatin | 1.33 |
| Acryl-modified copolymer (modification degree = 17%) of polyvinyl alcohol | 0.17 |
| Liquid paraffin | 0.03 |

Various additives used herein are described below.

(ExY) yellow coupler

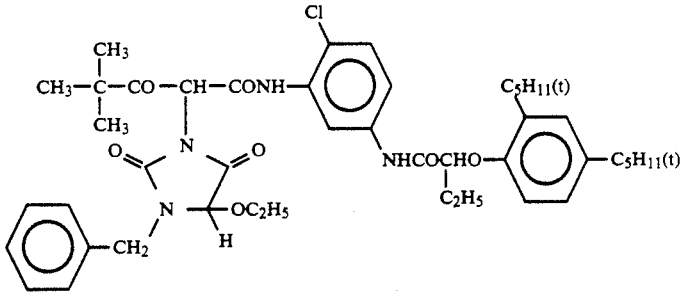

(ExM) magenta coupler

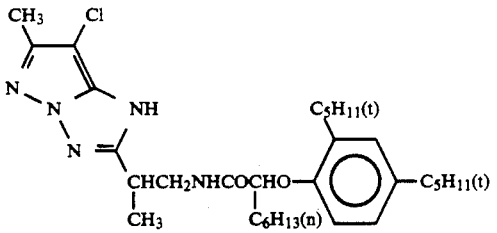

(ExC) cyan coupler

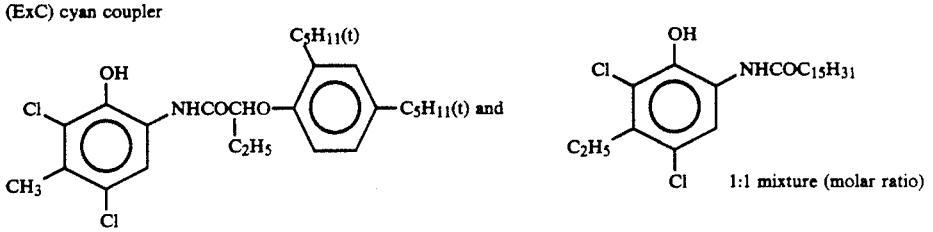

(Cpd-1) dye image stabilizer

-continued
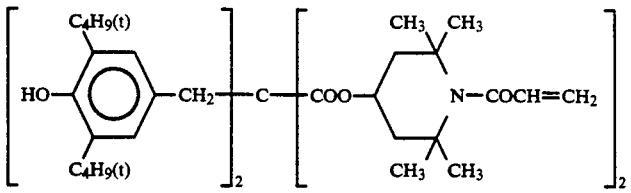
(Cpd-2) dye image stabilizer
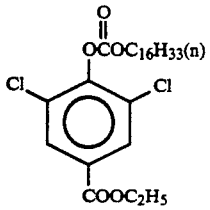
(Cpd-3) dye image stabilizer
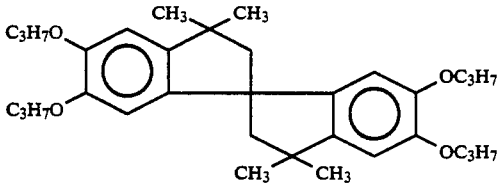
(Cpd-4) dye image stabilizer
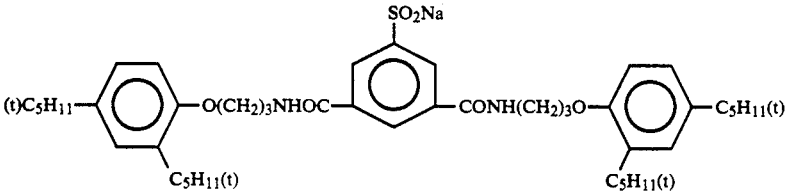
(Cpd-5) color mixing inhibitor
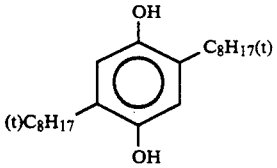
(Cpd-6) dye image stabilizer
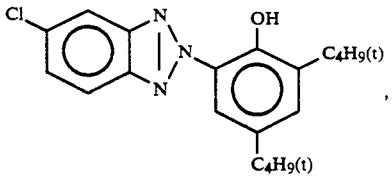
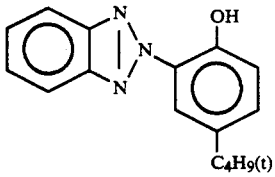
and
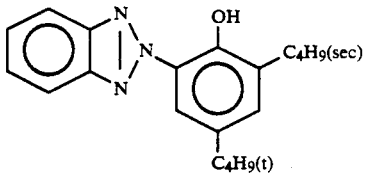
2:2:4 mixture (weight ratio)
(Cpd-7) dye image stabilizer
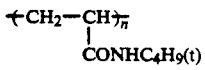
Average molecular weight 60,000
(Cpd-8) dye image stabilizer
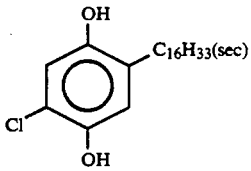
and
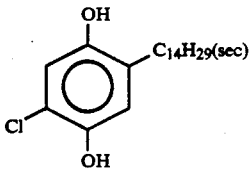
1:1 mixture (weight ratio)
(Cpd-9) dye image stabilizer
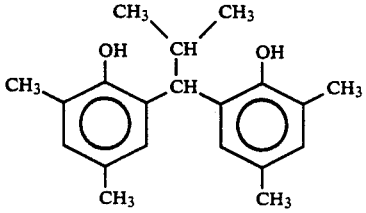
(Cpd-10) antiseptic
(Cpd-11) antiseptic

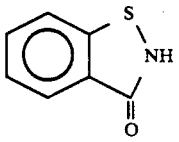
(Cpd-12) stabilizer
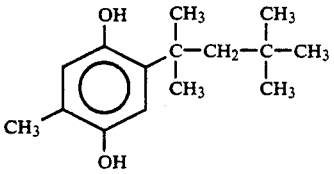
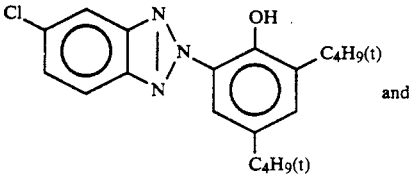
and
(H-1)
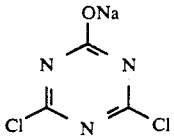
(Solv-1) solvent
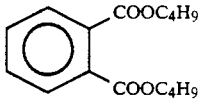
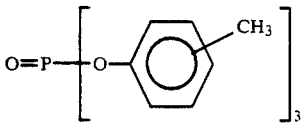
1:1 mixture (volume ratio)
(Solv-4) solvent
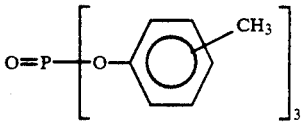
(Solv-6) solvent
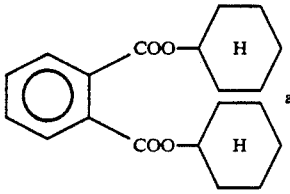
and
(Solv-7) solvent
-continued
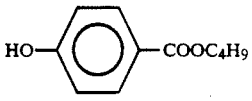
(UV-1) ultraviolet absorber
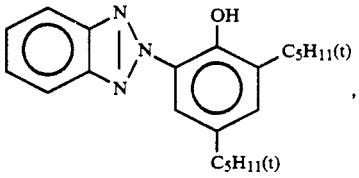
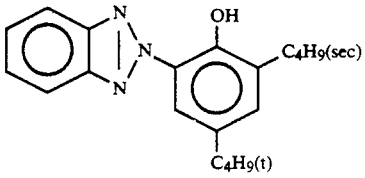
4:2:4 mixture (weight ratio)
(H-2)
$CH_2{=}CH{-}SO_2{-}CH_2{-}CONH{-}CH_2$
$CH_2{=}CH{-}SO_2{-}CH_2{-}CONH{-}CH_2$
(Solv-2) solvent
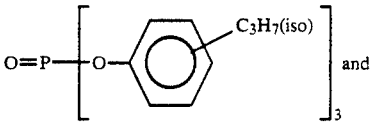
and
(Solv-3) solvent
$O{=}P{+}O{-}C_9H_{19}(iso)]_3$
(Solv-5) solvent
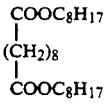
$C_8H_{17}CHCH(CH_2)_7COOC_8H_{17}$
O 80:20 mixture (volume ratio)

-continued $C_8H_{17}CHCH(CH_2)_7COOC_8H_{17}$
$\backslash\ /$
$O$

The above samples were subjected to sensitometry as follows. First, a sensitometer (FWH type available from Fuji Photo Film. Co. Ltd., color temperature of light source=3,200 K) was used to apply gradation exposure of a sensitometry (3-color) separation filter to each sample. The exposure in this case was performed with an exposure amount of 250 CMS for an exposure time of 0.1 sec.

By using a paper processor, the exposed samples were subjected to a continuous processing (running test) in accordance with processing steps and using processing solutions having compositions, shown in Tables 18 to 20, until the quantity of a replenisher became twice the tank volume of color development.

TABLE 18

| Processing Step | Temperature | Time | Replenisher* | Tank Volume |
|---|---|---|---|---|
| Color development | 35° C. | 45 sec. | 161 ml | 17 l |
| Bleach-fix | 35° C. | 45 sec. | 215 ml | 17 l |
| Rinsing 1 | 35° C. | 20 sec. | — | 10 l |
| Rinsing 2 | 35° C. | 20 sec. | — | 10 l |
| Rinsing 3 | 35° C. | 20 sec. | 360 ml | 10 l |
| Drying | 80° C. | 60 sec. | | |

*A replenisher is represented in a quantity per $m^2$ of a light-sensitive material. (3-tank counter flow piping from rinsing 3 to 1)

TABLE 19

| Color developer | Tank solution | Replenisher |
|---|---|---|
| Water | 700 ml | 700 ml |
| Ethylenediaminetetraacetic acid | 3.0 g | 3.0 g |
| Disodium 1,2-dihydroxybenzene-4.6-disulfonate | 0.5 g | 0.5 g |
| Triethanolamine | 12.0 g | 12.0 g |
| Potassium chloride | 1.6 g | — |
| Potassium bromide | 0.01 g | — |
| Potassium carbonate | 27.0 g | 27.0 g |
| Fluorescent brightener (WHITBX 4B available from SUMITOMO CHEMICAL CO., LTD.) | 1.0 g | 2.5 g |
| Sodium sulfite | 1.0 g | 0.2 g |
| Disodium-N,N-bis(sulfonato-ethyl)hydroxylamine | 8.0 g | 10.0 g |
| N-ethyl-N-(β-methanesulfon-amidoethyl)-3-methyl-4-aminoaniline sulfate | 5.0 g | 7.1 g |
| Water to make | 1,000 ml | 1,000 ml |
| pH (25° C.) | 10.05 | 10.45 |

TABLE 20

| Bleach-fix solution | (tank solution and replenisher are the same) |
|---|---|
| Water | 600 ml% |
| Ammonium thiosulfate (700 g/l) | 100 ml |
| Iron(III) ammonium ethylenediaminetetraacetate | 55 g |
| Ethylenediaminetetraacetic acid | 5 g |
| Ammonium bromide | 40 g |
| Nitric acid (67%) | 30 g |
| Water to make | 1,000 ml |
| pH (25° C.) (by acetic acid and ammonia water) | 5.8 |
| Rinsing solution | (tank solution and replenisher are the same) |
| Ion exchange water | (each of calcium and magnesium is |

TABLE 20-continued

| Bleach-fix solution | (tank solution and replenisher are the same) |
|---|---|
| 3 ppm or less) | |

Samples were prepared such that the yellow coupler (ExY) of the blue-sensitive emulsion layer was replaced with the comparative couplers and the couplers of the present invention used in Example 1, in an equimolar ratio. The same evaluation as in sample 1 were performed for these samples.

In this case, substantially the same effects as in Example 1 were obtained.

EXAMPLE 4

Layers having the following compositions were stacked on a subbed cellulose triacetate support to prepare a sample 101 as a multilayered color light-sensitive material.

Compositions of light-sensitive layers

Numbers corresponding to the respective components represent coating amounts in $g/m^2$. As for the silver halide, the numbers represent coating amounts figured out as silver contents. Note that the number represented by each sensitizing dye represents a coating amount (in mol) per mol of the silver halide of the same layer.

Sample 101

| | |
|---|---|
| First layer (Antihalation layer) | |
| Black colloidal silver | silver 0.18 |
| Gelatin | 1.40 |
| Second layer (Interlayer) | |
| 2,5-di-t-pentadecylhydroquinone | 0.18 |
| EX-1 | 0.18 |
| EX-3 | 0.20 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third layer (1st red-sensitive emulsion layer) | |
| Emulsion A | silver 0.25 |
| Emulsion B | silver 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Fourth Layer (2nd red-sensitive emulsion layer) | |
| Emulsion G | silver 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.20 |

-continued

| | | |
|---|---|---|
| EX-3 | | 0.050 |
| EX-10 | | 0.015 |
| EX-14 | | 0.20 |
| EX-15 | | 0.050 |
| U-1 | | 0.070 |
| U-2 | | 0.050 |
| U-3 | | 0.070 |
| Gelatin | | 1.30 |
| Fifth layer (3rd red-sensitive emulsion layer) | | |
| Emulsion D | silver | 1.60 |
| Sensitizing dye I | | $5.4 \times 10^{-5}$ |
| Sensitizing dye II | | $1.4 \times 10^{-5}$ |
| Sensitizing dye III | | $2.4 \times 10^{-4}$ |
| EX-2 | | 0.097 |
| EX-3 | | 0.010 |
| EX-4 | | 0.080 |
| HBS-1 | | 0.22 |
| HBS-2 | | 0.10 |
| Gelatin | | 1.63 |
| Sixth layer (Interlayer) | | |
| EX-5 | | 0.040 |
| HBS-1 | | 0.020 |
| Gelatin | | 0.80 |
| Seventh layer (1st green-sensitive emulsion layer) | | |
| Emulsion A | silver | 0.15 |
| Emulsion B | silver | 0.15 |
| Sensitizing dye IV | | $3.0 \times 10^{-5}$ |
| Sensitizing dye V | | $1.0 \times 10^{-4}$ |
| Sensitizing dye VI | | $3.8 \times 10^{-4}$ |
| EX-1 | | 0.021 |
| EX-6 | | 0.26 |
| EX-7 | | 0.030 |
| EX-8 | | 0.025 |
| HBS-1 | | 0.10 |
| HBS-3 | | 0.010 |
| Gelatin | | 0.63 |
| Eighth layer (2nd green-sensitive emulsion layer) | | |
| Emulsion C | silver | 0.45 |
| Sensitizing dye IV | | $2.1 \times 10^{-5}$ |
| Sensitizing dye V | | $7.0 \times 10^{-5}$ |
| Sensitizing dye VI | | $2.6 \times 10^{-4}$ |
| EX-6 | | 0.094 |
| EX-7 | | 0.026 |
| EX-8 | | 0.018 |
| HBS-1 | | 0.16 |
| HBS-3 | | $8.0 \times 10^{-3}$ |
| Gelatin | | 0.50 |
| Ninth layer (3rd green-sensitive emulsion layer) | | |
| Emulsion E | silver | 1.20 |
| Sensitizing dye IV | | $3.5 \times 10^{-5}$ |
| Sensitizing dye V | | $8.0 \times 10^{-5}$ |
| Sensitizing dye VI | | $3.0 \times 10^{-4}$ |
| EX-1 | | 0.013 |
| EX-11 | | 0.065 |
| EX-13 | | 0.019 |

-continued

| | | |
|---|---|---|
| HBS-1 | | 0.25 |
| HBS-2 | | 0.10 |
| Gelatin | | 1.54 |
| Tenth layer (Yellow filter layer) | | |
| Yellow colloidal silver | silver | 0.050 |
| EX-5 | | 0.080 |
| HBS-1 | | 0.030 |
| Gelatin | | 0.95 |
| Eleventh layer (1st blue-sensitive emulsion layer) | | |
| Emulsion A | silver | 0.080 |
| Emulsion B | silver | 0.070 |
| Emulsion F | silver | 0.070 |
| Sensitizing dye VII | | $3.5 \times 10^{-4}$ |
| EX-8 | | 0.042 |
| EX-9 | | 0.72 |
| HBS-1 | | 0.28 |
| Gelatin | | 1.10 |
| Twelfth layer (2nd blue-sensitive emulsion layer) | | |
| Emulsion G | silver | 0.45 |
| Sensitizing dye VII | | $2.1 \times 10^{-4}$ |
| EX-9 | | 0.15 |
| EX-10 | | $7.0 \times 10^{-3}$ |
| HBS-1 | | 0.050 |
| Gelatin | | 0.78 |
| Thirteenth layer (3rd blue-sensitive emulsion layer) | | |
| Emulsion H | silver | 0.77 |
| Sensitizing dye VII | | $2.2 \times 10^{-4}$ |
| EX-9 | | 0.20 |
| HBS-1 | | 0.070 |
| Gelatin | | 0.69 |
| Fourteenth layer (1st protective layer) | | |
| Emulsion I | silver | 0.20 |
| U-4 | | 0.11 |
| U-5 | | 0.17 |
| HBS-1 | | $5.0 \times 10^{-2}$ |
| Gelatin | | 1.00 |
| Fifteenth layer (2nd protective layer) | | |
| H-1 | | 0.40 |
| B-1 (diameter = 1.7 fm) | | $5.0 \times 10^{-2}$ |
| B-2 (diameter = 1.7 fm) | | 0.10 |
| B-3 | | 0.10 |
| S-1 | | 0.20 |
| Gelatin | | 1.20 |

In addition, in order to improve storage stability, processability, a resistance to pressure, antiseptic and mildewproofing properties, antistatic properties, and coating properties, W-1, W-2, W-3, B-4, B-5, F-1, F-2, F-3, F-4, F-5, F-6, F-7, F-8, F-9, F-10, F-11, F-12, F-13, and an iron salt, a lead salt, a gold salt, a platinum salt, an iridium salt, and a rhodium salt were added to all of the above layers. Emulsions A to I used in this Example are shown in Table 21 below, and various additives used are indicated below.

TABLE 21

| | Average AgI Content (%) | Average Grain Size (μm) | Variation Coefficient Associated with Grain Size (%) | Diameter/ Thickness Ratio | Silver Content Ratio (AgI Content %) |
|---|---|---|---|---|---|
| Emulsion A | 4.0 | 0.45 | 27 | 1 | Core/shell = ½ (13/1), Double structure grain |
| Emulsion B | 8.9 | 0.70 | 14 | 1 | Core/shell = 3/7 (25/2), Double structure grain |
| Emulsion C | 10 | 0.75 | 30 | 2 | Core/shell = ½ (24/3), Double structure grain |
| Emulsion D | 16 | 1.05 | 35 | 2 | Core/shell = 4/6 (40/0), Double structure grain |
| Emulsion E | 10 | 1.05 | 35 | 3 | Core/shell = ½ (24/3), Double structure grain |

TABLE 21-continued

| | Average AgI Content (%) | Average Grain Size (μm) | Variation Coefficient Associated with Grain Size (%) | Diameter/ Thickness Ratio | Silver Content Ratio (AgI Content %) |
|---|---|---|---|---|---|
| Emulsion F | 4.0 | 0.25 | 28 | 1 | Core/shell = ⅓ (13/1), Double structure grain |
| Emulsion G | 14.0 | 0.75 | 25 | 2 | Core/shell = ½ (42/0), Double structure grain |
| Emulsion H | 14.5 | 1.30 | 25 | 3 | Core/shell = 37/63 (34/3), Double structure grain |
| Emulsion I | 1 | 0.07 | 15 | 1 | Uniform grain |

EX-1

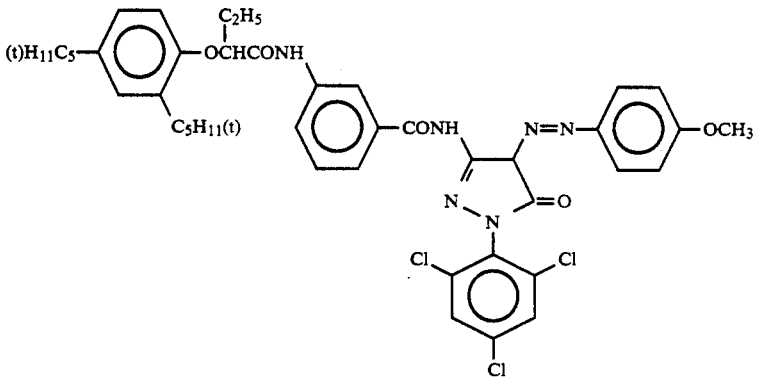

EX-2

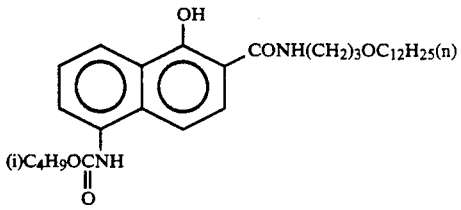

EX-3

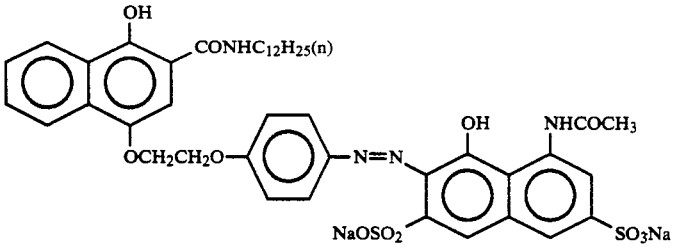

EX-4

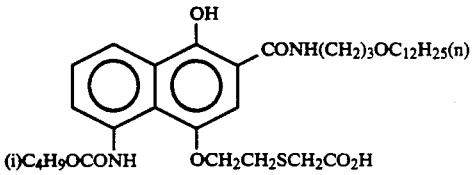

EX-5

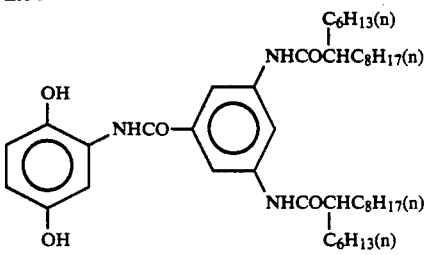

EX-6

-continued
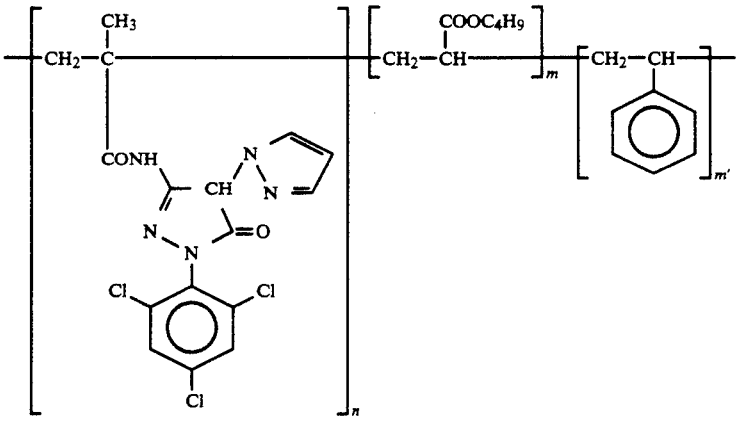
n = 50
m = 25
m' = 25
molecular weight about 20,000
EX-7
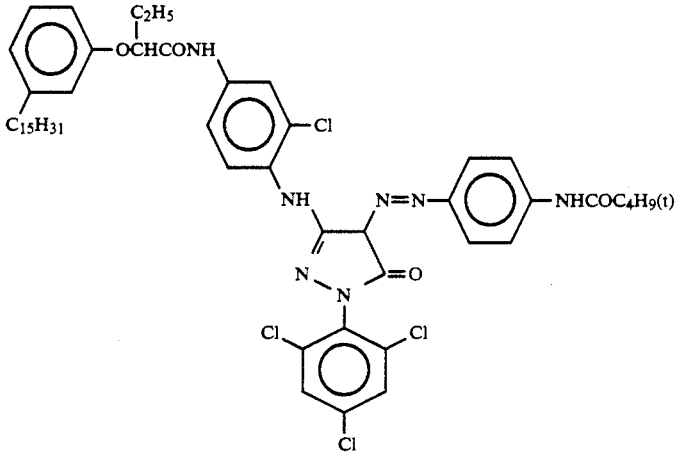
EX-8
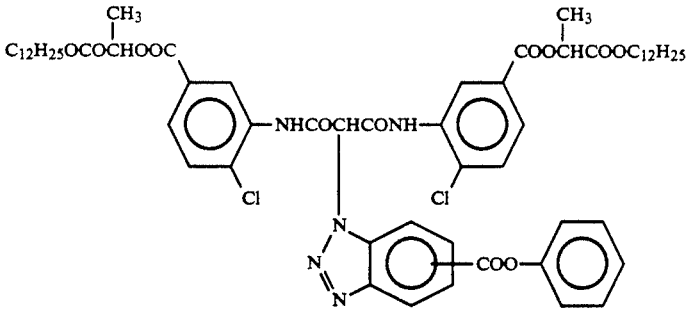
EX-9
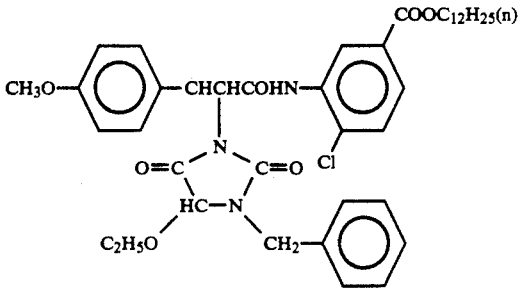
EX-10

-continued
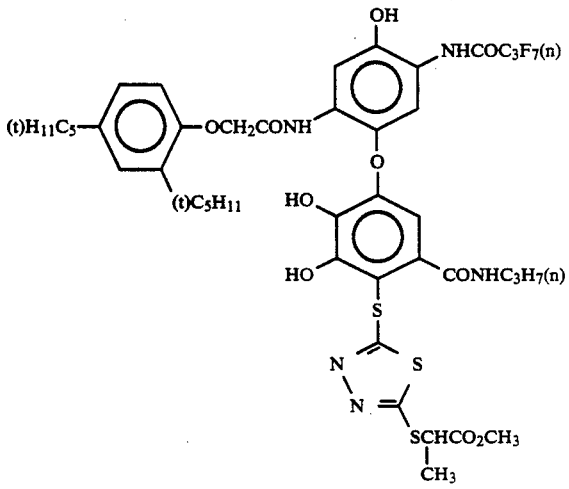
EX-11
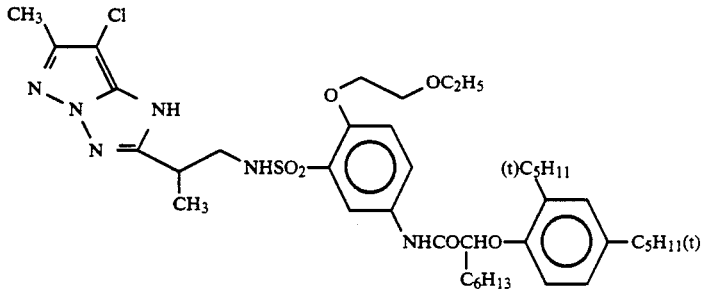
EX-12
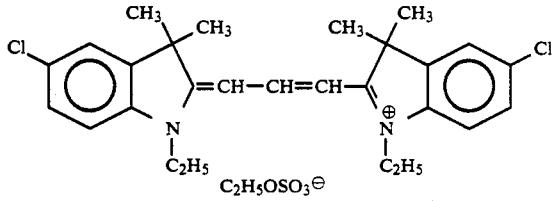
EX-13
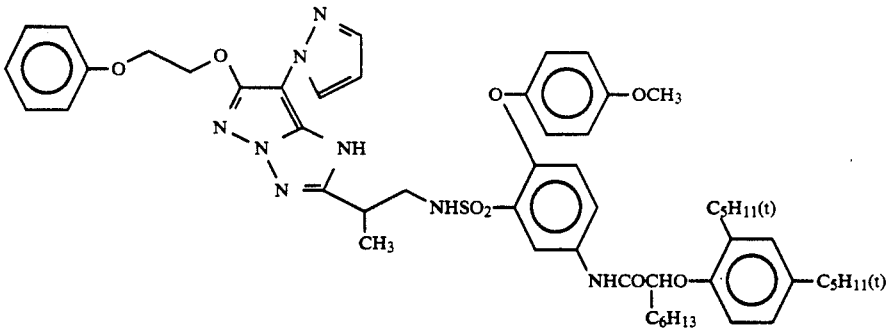
EX-14
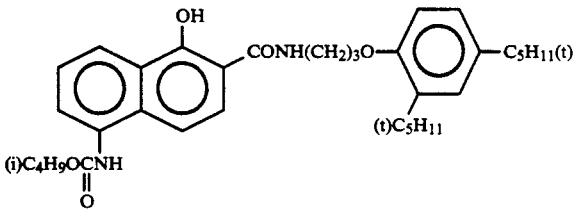
EX-15

-continued
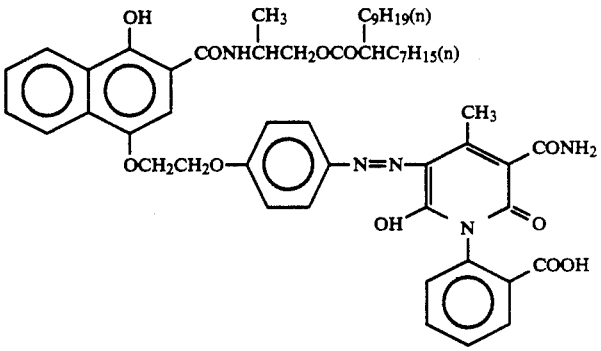
U-1
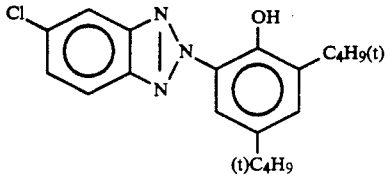
U-2
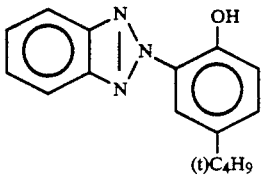
U-3
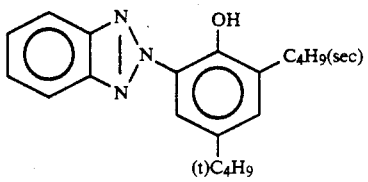
U-1
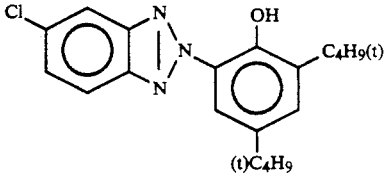
U-2
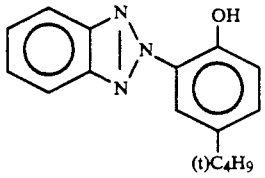
U-3
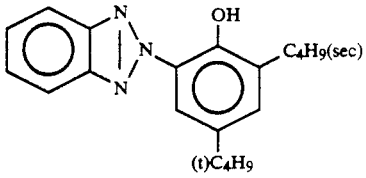
U-4
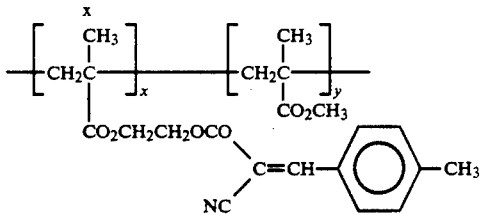
x:y = 70:30 (weight %)
U-5
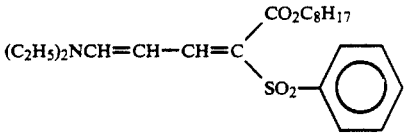
HBS-1
Tricresyl phosphate
HBS-2
Di-n-butyl phthalate
HBS-3
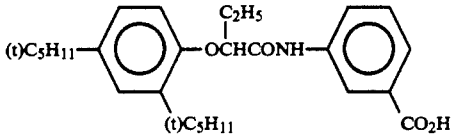
sensitizing dye I
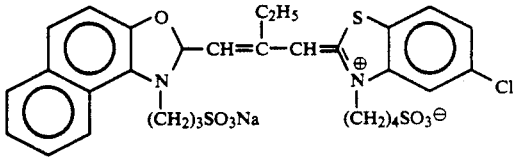
sensitizing dye II
sensitizing dye III -continued
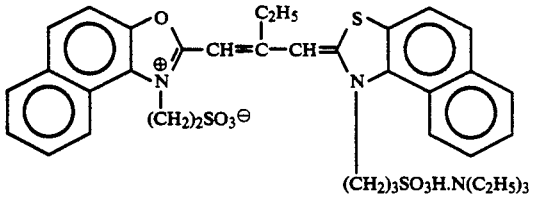
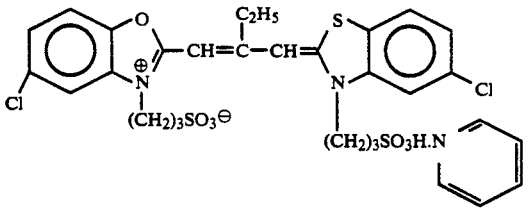
x:y = 70:30 (weight %)
sensitizing dye IV
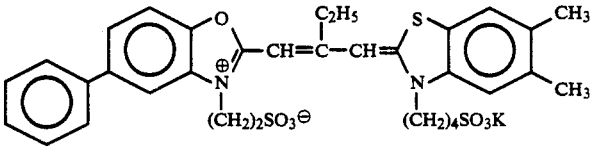
sensitizing dye V
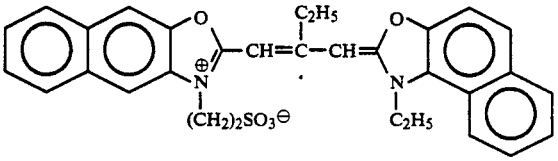
sensitizing dye VI
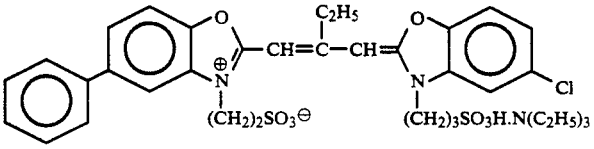
sensitizing dye VII
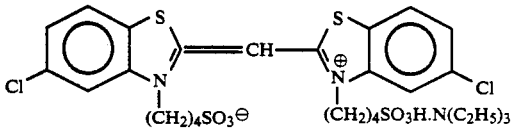
S-1
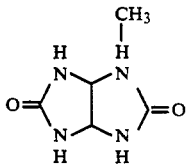
H-1
$CH^2{=}CH-SO_2-CH2-CONH-CH_2$
$CH_2{=}CH-SO_2-CH_2-CONH-CH_2$
B-1
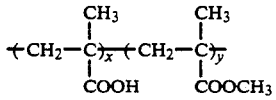
x/y = 10/90
B-2
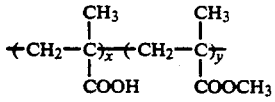
x/y = 40/60
B-3
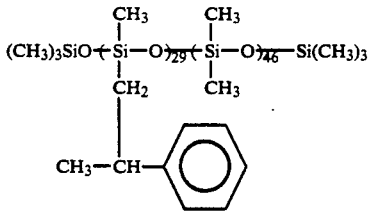
B-4
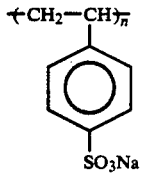
B-5
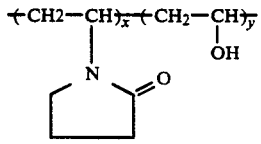
x/y = 70/30

W-1
$C_8F_{17}SO_2NHCH_2CH_2CH_2OCH_2CH_2\overset{\oplus}{N}(CH_3)_3$
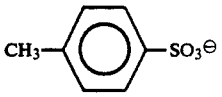
-continued
W-2
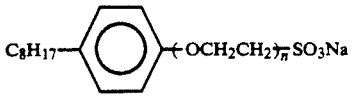
n = 2 to 4
W-3
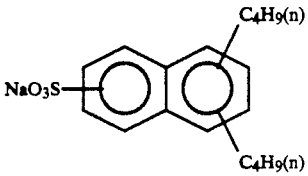
F-1
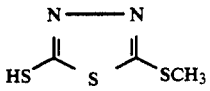
F-2
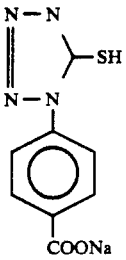
F-3
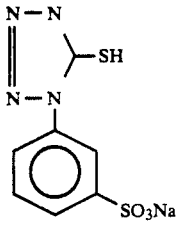
F-4
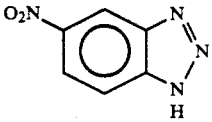
F-5
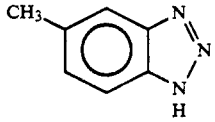
F-6
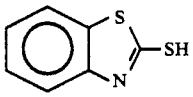
F-7
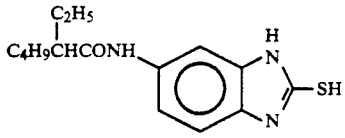
F-8
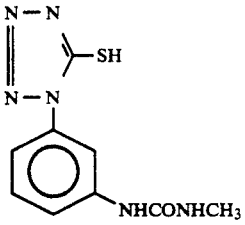
F-9
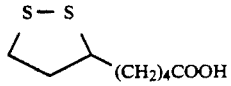
F-10
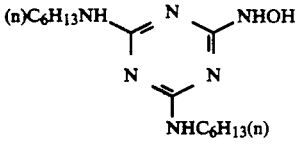
F-11
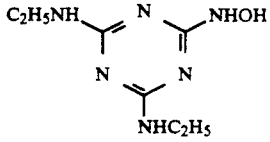
F-12
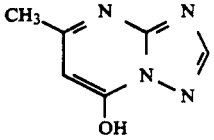
F-13
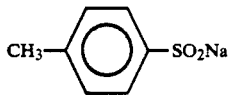
Samples were prepared such that the yellow couplers EX-9 of the eleventh, twelfth, and thirteenth layers of These samples were subjected to sensitometry as follows. First, a sensitometer (FWH type available from Fuji Photo Film. Co. Ltd., color temperature of light source=4,800 K) was used to apply gradation exposure to each sample. The exposure in this case was performed with an exposure amount of 20 CMS for an exposure time of 0.01 sec.

By using a negative automatic developing processor, the exposed samples were subjected to a continuous processing (running test) in accordance with processing steps and using processing solutions having compositions, shown in Tables 22 to 27, until the quantity of a replenisher became three times the tank volume of color development.

TABLE 22

| Processing Step | Temperature | Time | Replenisher* | Tank Volume |
|---|---|---|---|---|
| Color development | 38° C. | 3 min. 15 sec. | 45 ml | 10 l |
| Bleaching | 38° C. | 1 min. 00 sec. | 20 ml | 4 l |
| Bleach-fixing | 38° C. | 3 min. 15 sec. | 30 ml | 8 l |
| Water washing (1) | 35° C. | 40 sec. | alternating flow piping method from (2) to (1) | 4 l |
| Water (2) | 35° C. | 1 min. 00 sec. | 30 ml | 4 l |
| Stabilization | 38° C. | 40 sec. | 20 ml | 4 l |
| Drying | 55° C. | | | |

A quantity of replenisher is a quantity per meter of a 35-mm wide sample.

TABLE 23

| Color forming developing solution | Mother solution | Replenisher |
|---|---|---|
| Water | 700 ml | 700 ml |
| Diethylenetriaminepentaacetic acid | 1.0 g | 1.1 g |
| 1-hydroxyethylidene-1,1-diphosphnic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.4 g | 2.8 g |
| 4-(N-ethyl-N-(β-hydroxyethylamino-2-methylaniline sulfate | 4.5 g | 5.5 g |
| Water to make | 1,000 ml | 1,000 ml |
| pH (25° C.) | 10.05 | 10.10 |

TABLE 24

| Bleaching solution | (Common for mother solution and replenisher) |
|---|---|
| Water | 700.0 ml |
| Iron(III) ammonium ethylenediamine-tetraacetate dihydrate | 120.0 g |
| Disodium ethylenediamine-tetraacetate | 10.0 g |
| Ammonium bromide | 100.0 g |
| Ammonium nitrate | 10.0 g |
| Bis(N,N-dimethylaminoethyl)sulfide hydrochloride | 1.4 g |
| Ammonia water (27%) | 15.0 ml |
| Water to make | 1,000.0 ml |
| pH (25° C.) | 6.3 |

TABLE 24

| Bleaching solution | (Common for mother solution and replenisher) |
|---|---|
| Water | 700.0 ml |
| Iron(III) ammonium ethylenediamine-tetraacetate dihydrate | 120.0 g |
| Disodium ethylenediamine-tetraacetate | 10.0 g |
| Ammonium bromide | 100.0 g |
| Ammonium nitrate | 10.0 g |
| Bis(N,N-dimethylaminoethyl)sulfide hydrochloride | 1.4 g |
| Ammonia water (27%) | 15.0 ml |
| Water to make | 1,000.0 ml |
| pH (25° C.) | 6.3 |

TABLE 26

Washing solution

Common for mother solution and replenisher

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400: available from Rohm & Haas Co.) to set the concentrations of calcium and magnesium ions to be 3 mg/l or less. Subsequently, 20 mg/l of sodium isocyanuric acid dichloride and 0.15 g/l of sodium sulfate were added. The pH of the solution fell within the range of 6.5 to 7.5.

TABLE 27

| Stabilizing solution | (Common for mother solution and replenisher) |
|---|---|
| Formalin (37%) | 2.0 ml |
| Polyoxyethylene-p-monononylphenyl ether (average polymerization degree = 10) | 0.3 g |
| Disodium ethylenediaminetetraacetate | 0.05 g |
| Water to make | 1000.0 ml |
| pH (25° C.) | 0.5–8.0 |

The color forming properties were evaluated by comparing color forming densities with reference to the fog densities of the respective samples at an exposure amount for giving a color forming density which was 1.5 times the fog density of sample 101.

The dye image stabilities of the samples were evaluated by decreases in dye image densities for an initial density of 1.5 (with reference to the fog density) after the samples were stored at a temperature of 60° C. and a humidity of 70%RH for 14 days.

Substantially the same results as in Example 2 were obtained.

What is claimed is:

1. A silver halide color photographic light-sensitive material containing at least one acylacetamide-type yellow dye-forming coupler in which the acyl group is selected from the group consisting of a bicyclo(1.1.1)-pentane-1-carbonyl group, a bicyclo(2.1.1.)hexane-1-carbonyl group, a bicyclo(2.2.1)heptane-1-carbonyl group, a bicyclo-(2.2.2)octane-1-carbonyl group, a tricyclo(3.1.1.0$^{3,6}$)-heptane-6-carbonyl group, a tricyclo(3.3.0.0$^{3,7}$)-octane-1-carbonyl group, and a tricyclo(3.3.1.0$^{3,7}$)-nonane-3-carbonyl group, provided that if the acyl group is a bicyclo(2.2.1)heptane-1-carbonyl group, one in which the 7-position is substituted is excluded.

2. The light-sensitive material according to claim 1, wherein said coupler is represented by a formula:

$$A-Y_R$$

where A is said acyl group, and $Y_R$ is a residue of said coupler in which said acyl group is removed.

3. The light-sensitive material according to claim 1, wherein said coupler is represented by the following formula (1):

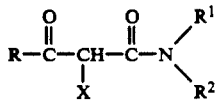

formula (1)

where R represents a bicyclo(1.1.1)pentane-1yl, a bicyclo(2.2.1)hexane-1-yl, a bicyclopentane(2.2.1)-heptane-1-yl, a bicyclo(2.2.2)octane-1-yl, a tricyclo-(3.1.1.$0^{3,6}$)heptane-6-yl, a tricyclo(3.3.0.$0^{3,7}$)-nonane-1-yl, or a tricyclo(3.3.1.$0^{3,7}$)-nonane-3-yl group, provided that if R is a bicyclo(2.2.1) heptane-1-yl group, one in which the 7-position is substituted is excluded; each of $R^1$ and $R^2$ independently represents a hydrogen atom, an alkyl group, a cycloalky group, an alkenyl group, an alkinyl group, an aralkyl group, an aryl group, or a heterocyclic group; and X represents a hydrogen atom, or a group which can split off upon a coupling reaction with an oxidized form of an aromatic primary amine developing agent.

4. The light-sensitive material according to claim 3, wherein X is a heterocyclic group which bonds to the coupling position through a nitrogen atom, an aryloxy group, an arylthio group, an acyloxy group, an alkylsulfonyloxy group, an arylsulfonyloxy group, a heterocyclic oxy group, or a halogen atom.

5. The light-sensitive material according to claim 1, wherein said coupler is represented by the following formula (2):

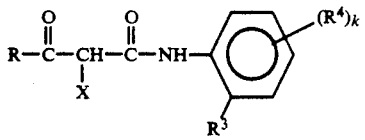

formula (2)

where R represents a bicyclo(1.1.1)pentane-1-yl, a bicyclo(2.1.1)hexane-1-yl, a bicyclopentane(2.2.1)-heptane-1-yl, a bicyclo(2.2.2)octane-1-yl, a tricyclo-(3.1.1.$0^{3,6}$)heptane-6-yl, a tricyclo(3.3.0.$0^{3,7}$)-nonane-1-yl, or a tricyclo(3.3.1.$0^{3,7}$)-nonane-3-yl group, provided that if R is a bicyclo(2.2.1)heptane-1-yl group, one in which the 7-position is substituted is excluded; X represents a hydrogen atom or a group which can split off upon a coupling reaction with an oxidized form of an aromatic primary amine developing agent; $R^3$ represents a hydrogen atom; a halogen atom, an alkoxy group, an aryloxy group, an alkyl group, or an amino group; $R^4$ represents a group substitutable on a benzene ring; and k represents an integer of 0 to 4.

6. The light-sensitive material according to claim 5, wherein $R^4$ is selected from the group consisting of a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an ureido group, a sulfamoylamino group, an alkoxycarbonylamino group, an alkoxysulfonyl group, an acyloxy group, nitro group, a heterocyclic group, cyano group, an acyl group, an amino group, an imido group, an alkylsulfonyloxy group, an arylsulfonyloxy group, a carboxyl group, sulfo group, and a hydroxyl group.

7. The light-sensitive material according to claim 5, wherein in formula (2), $R^3$ represents a halogen atom, or an alkoxy group having 1 to 30 carbon atoms, an aryloxy group having 6 to 30 carbon atoms, an alkyl group having 1 to 30 carbon atoms, or an amino group having 0 to 30 carbon atoms, which group may be substituted.

8. The light-sensitive material according to claim 5, wherein in formula (2), $R^4$ represents a halogen atom, an alkyl group having 1 to 30 carbon atoms, an aryl group having 6 to 30 carbon atoms, an alkoxy group having 1 to 30 carbon atoms, an alkoxycarbonyl group having 2 to 30 carbon atoms, an aryloxycarbonyl group having 7 to 30 carbon atoms, a carbonamido group having 1 to 30 carbon atoms, a sulfonamido group having 1 to 30 carbon atoms, a carbamoyl group having 1 to 30 carbon atoms, a sulfamoyl group having 0 to 30 carbon atoms, an alkylsulfonyl group having 1 to 30 carbon atoms, an arylsulfonyl group having 6 to 30 carbon atoms, an ureido group having 1 to 30 carbon atoms, a sulfamoylamino group having 0 to 30 carbon atoms, an alkoxycarbonylamino group having 2 to 30 carbon atoms, a heterocyclic group having 1 to 30 carbon atoms, an acyl group having 1 to 30 carbon atoms, an alkylsulfonyloxy group having 1 to 30 carbon atoms, or an arylsulfonyloxy group having 6 to 30 carbon atoms, which may be substituted.

9. The light-sensitive material according to claim 5, wherein $R^3$ represents chlorine atom, fluorine atom, an alkyl group having 1 to 6 carbon atoms, an alkoxy group having 1 to 24 carbon atoms, or an aryloxy group having 6 to 24 carbon atoms.

10. The light-sensitive material according to claim 5, wherein $R^4$ represents a halogen atom, an alkoxy group, an alkoxycarbonyl group, an aryloxycarbonyl group, a carbonamido group, a sulfonamido group, a carbamoyl group, or a sulfamoyl group.

11. The light-sensitive material according to claim 1, wherein said acyl group is represented by the following formula (3), (4), (5), (6), (7), (8), or (9):

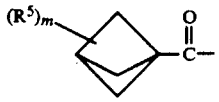

formula (3)

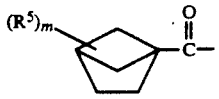

formula (4)

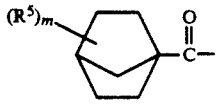

formula (5)

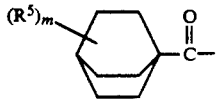

formula (6)

-continued formula (7)

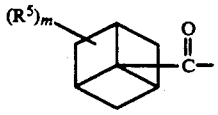

formula (8)

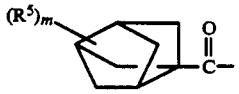

formula (9)

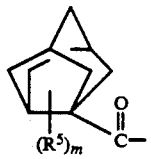

where $R^5$ represents a group substitutable to bicycloalkane or tricycloalkane; and m represents an integer of 0 to 7, and if m represents 2 or more, the plural groups $R^5$ may be the same or different; provided that $R^5$ is not substituted at the 7-position of the group represented by formula (5).

12. The light-sensitive material according to claim 11, wherein said acyl group is represented by formula (3), (4), or (7).

13. The light-sensitive material according to claim 11, wherein said acyl group is represented by formula (5), (6), (8) or (9).

14. The light-sensitive material according to claim 11, wherein said $R^5$ is a halogen, cyano, an alkyl, an aryl, or an acyl group.

15. The light-sensitive material according to claim 11, wherein $R^5$ is selected from the group consisting of a halogen atom, cyano group, an alkyl group, an aryl group, an alkoxy group, an aryloxy group, an alkylthio group, an arylthio group, an alkylsulfonyl group, an arylsulfonyl group, an acyl group, an alkoxycarbonyl group, an aryloxycarbonyl group, a carbonamido group, a sulfonamido group, an imide group, a heterocyclic group, a carbamoyl group, a sulfamoyl group, an alkoxycarbonylamino group, a sulfamoylamino group, a phosphono group, an ureido group, carboxyl group, a sulfo group, and hydroxyl group.

16. The light-sensitive material according to claim 11, wherein m represents an integer of 0 to 4.

17. The light-sensitive material according to claim 11, wherein the group represented by formula (3) has 6 to 36 carbon atoms, the group represented by formula (4) has 7 to 36 carbon atoms, the group represented by formula (5) has 8 to 36 carbon atoms, the group represented by formula (6) has 9 to 36 carbon atoms, the group represented by formula (7) has 8 to 36 carbon atoms, the group represented by formula (8) has 9 to 36 carbon atoms, and the group represented by formula (9) has 10 to 36 carbon atoms.

18. The light-sensitive material according to claim 1, wherein said acyl group is the bicyclo(1.1.1)pentane-1-carbonyl group.

19. The light-sensitive material according to claim 1, wherein said acyl group is the bicyclo(2.1.1)hexane-1-carbonyl group.

20. The light-sensitive material according to claim 1, wherein said acyl group is the tricyclo(3.3.1.$0^{3,7}$)nonane-3-carbonyl group.

* * * * *